US008322682B2

(12) United States Patent
Maercovich

(10) Patent No.: US 8,322,682 B2
(45) **Date of Patent: *Dec. 4, 2012**

(54) METHOD AND ARRANGEMENT FOR CONTROLLING FLUSH WATER VOLUME

(75) Inventor: Jorge Maercovich, Chatsworth, CA (US)

(73) Assignee: Advanced Modern Technologies Corp., Woodland Hills, CA (US)

( * ) Notice: Subject to any disclaimer, the term of this patent is extended or adjusted under 35 U.S.C. 154(b) by 1189 days.

This patent is subject to a terminal disclaimer.

(21) Appl. No.: 12/215,117

(22) Filed: Jun. 24, 2008

(65) Prior Publication Data

US 2009/0133186 A1 May 28, 2009

Related U.S. Application Data

(60) Provisional application No. 61/004,681, filed on Nov. 28, 2007.

(51) Int. Cl.
*F16L 37/28* (2006.01)

(52) U.S. Cl. ..... 251/40; 251/33

(58) Field of Classification Search ..... 251/33, 251/37, 40

See application file for complete search history.

(56) References Cited

U.S. PATENT DOCUMENTS

| | | | | |
|---|---|---|---|---|
| 4,134,570 | A * | 1/1979 | Walker | 251/40 |
| 4,272,052 | A * | 6/1981 | Gidner | 251/39 |
| 7,607,635 | B2 * | 10/2009 | Wilson | 251/40 |
| 8,033,522 | B2 * | 10/2011 | Wilson | 251/40 |
| 8,042,787 | B2 * | 10/2011 | Wilson | 251/40 |

* cited by examiner

*Primary Examiner* — John K Fristoe, Jr.
*Assistant Examiner* — Umashankar Venkatesan
(74) *Attorney, Agent, or Firm* — Raymond Y. Chan; David and Raymond Patent Firm

(57) ABSTRACT

A flush system includes a valve body, a valve seat, a flushing shaft and a flush water control arrangement which includes a flush actuator and a water control pusher. The flush actuator is adapted to move between a high and a low volume actuating position. The water control pusher includes a low and a high volume pusher member spacedly extended from the flush actuator, in such a manner that when the flush actuator is moved to the high volume actuating position, the high volume pusher member is driven to move to pivotally move the flushing shaft at the higher pushing position for producing a high volume of flush water, wherein when the flush actuator is move to the low volume actuating position, the low volume pusher member is driven to move to pivotally move the flushing shaft at the lower pushing position for producing a low volume of flush water.

19 Claims, 22 Drawing Sheets

METHOD AND ARRANGEMENT FOR CONTROLLING FLUSH WATER VOLUME

CROSS REFERENCE OF RELATED APPLICATION

This is a non-provisional application of a provisional application having an application No. 61/004,681 and a filing date of Nov. 28, 2007.

BACKGROUND OF THE PRESENT INVENTION

1. Field of Invention

The present invention relates to a flush system, and more particularly to a flush system comprising a flush water control arrangement which is capable of effectively controlling a flow volume of flush water during a flushing operation.

2. Description of Related Arts

Urinal and toilet flush systems have been well-known as one of the most significant inventions in the last century. A conventional toilet or urinal flush system comprises a valve body having a water inlet and a water outlet, a diaphragm having a water channel communicating between the water inlet and the water outlet, a relief valve disposed at the diaphragm for blocking the water flowing from the water inlet to the water outlet through the water channel, and a flush actuator arranged to move the relief valve at a position where the water is allowed flow to the water outlet for completing the flushing operation.

Conventionally, the relief valve has a pivotal pin member longitudinally and downwardly extended therefrom in the water channel, whereas the flush actuator comprises an elongated actuating member transversely and pivotally extended from the valve body, and a pusher pin transversely and movably extended in the valve body to align with the pivotal pin, in such a manner that when the elongated actuating member is pivotally moved in a predetermined direction (such as a downward direction with respect to the valve body), the pusher pin is transversely pushed to drive the pivotal pin to pivotally move within the valve body so as to open the relief valve for allowing water flowing through water channel. As a result, a user is able to flush the toilet by actuating the flush actuator.

A major drawback for this conventional toilet flush system is that the user is unable to control the volume of water flow so that unnecessary waste of water is prevalent. In other words, the conventional flush system will allow a standard time and volume of flushing regardless of purpose thereof. For example, when the user wishes to flush away a certain piece of toilet paper in the toilet bowl, he or she is unable to adjust the volume of flushing water so that the flushing cycle in this particular instance is exactly the same as any usual flushing cycle for this particular flush system. This is obviously undesirable from environmental as well as economical point of view.

There exist several types of flush systems which include certain types of water adjustment mechanisms which are claimed to be capable of controlling the volume of water during a typical flush cycle. However, the major problem for these kinds of water adjustment mechanisms is that their efficacy of effectively controlling the volume of flushing water among a plurality of operation modes is in doubt. For example, a conventional flush system equipped with a conventional water adjustment mechanism may have two modes of operations, namely a regular flush cycle and a water-saving flush cycle, in which the latter is supposed to require less water than the former. However, the reality is that very often, there is no noticeable or significant difference in water consumption between these two modes of operations so that there is no practical distinction between these two modes of operations. From engineering point of view, when the water adjustment mechanism produces no significant difference in water consumption, there is actually no reason or incentive to produce a flush system having such a water adjustment mechanism because it will certainly increase the manufacturing cost of that flush system.

It is submitted that the main reason for this ineffectiveness in controlling the volume of flush water is that one is hard to accurately control the period for which the relief valve is opened by one single actuating member. Thus, it is possible that the time of opening the relief valve in the two modes of operations is very much the same so that there is no noticeable difference in water volume between these two modes of operation.

SUMMARY OF THE PRESENT INVENTION

A main object of the present invention is to provide a flush system comprising a flush water control arrangement which is capable of effectively controlling a flow volume of flush water during a flushing operation.

Another object of the present invention is to provide a flush system comprising a water control arrangement, wherein a flushing shaft extended from a valve seat of the flush system is pushed at two spacedly apart positions on the flushing shaft so as to effectively control the period for which the valve seat is opened for effectively controlling the volume of flush water at two separate modes of operation.

Another object of the present invention is to provide a flush system comprising a water control arrangement, which does not in any way interfere with a normal operation of the flush system (except an adjustment of the volume of flush water), so as to allow the water control arrangement to be incorporated into a wide range of conventional flush systems without undue burden on the part of flush system manufacturers. In other words, the present invention can be kept to have the minimal manufacturing cost.

Another object of the present invention is to provide a method of actuating a flush system which is capable of effectively controlling a flow volume of flush water during a flushing cycle.

Accordingly, in order to accomplish the above object, the present invention provides a flush system, comprising:

a valve body having a water inlet communicating with a water source, a water outlet, and a water chamber communicating between the water inlet and the water outlet;

a valve seat supported in the valve body to move between a normal idle position and a flushing position, wherein at the idle position, the valve seat is sealed at the water chamber for retaining a water pressure within the water chamber so as to block flush water flowing from the water inlet to the water outlet, and at the flushing position, the valve seat is moved to relief the water pressure for allowing the flush water flowing towards the toilet through the water outlet so as to complete a flushing operation;

a flushing shaft extended from the valve seat in the valve body for being moved to drive the valve seat to move between the idle position and the flushing position, wherein the flushing shaft defines a lower pushing position and a higher pushing position; and a flush water control arrangement, which comprises:

a flush actuator comprising an actuator handle movably extended from the flow actuator for being actuated to activate the flushing operation, wherein the flush actuator is adapted to move between a high volume actuating position and a low volume actuating position; and a water control pusher comprising a low volume pusher member and a high volume pusher member spacedly supported and extended from the flush actuator, in such a manner that when the flush actuator is moved to the high volume actuating position, the high volume pusher member is driven to move by the flush actuator to pivotally move the flushing shaft at the higher pushing position for allowing a high volume of water flowing through the valve seat, wherein when the flush actuator is move to the low volume actuating position, the low volume pusher member is driven to move by the flush actuator to pivotally move the flushing shaft at the lower pushing position for allowing a low volume of water flowing through the valve seat, thereby a user is able to control a flush volume of the water by actuating the flush actuator between the high volume actuating position and the low volume actuating position.

Moreover, the present invention provides a method of actuating a flush system comprising a valve body, a valve seat and a flushing shaft extended from the valve seat, wherein the method comprises the steps of:

(a) providing a flush actuator comprising an actuator handle movably extended from the valve body for being actuated to activate the flushing operation, wherein the flush actuator is adapted to move between a high volume actuating position and a low volume actuating position; and (b) providing a water control pusher comprising a low volume pusher member and a high volume pusher member spacedly supported and extended from the flush actuator; and (c) actuating the flushing actuator in such a manner that when the flush actuator is moved to the high volume actuating position, the high volume pusher member is driven to move by the flush actuator to pivotally move the flushing shaft at the higher pushing position for allowing a high volume of water flowing through the valve seat, wherein when the flush actuator is move to the low volume actuating position, the low volume pusher member is driven to move by the flush actuator to pivotally move the flushing shaft at the lower pushing position for allowing a low volume of water flowing through the valve seat, so that a user is able to control a flush volume of the water by actuating the flush actuator between the high volume actuating position and the low volume actuating position.

These and other objectives, features, and advantages of the present invention will become apparent from the following detailed description, the accompanying drawings, and the appended claims.

DETAILED DESCRIPTION OF THE PREFERRED EMBODIMENT

Figure 1:
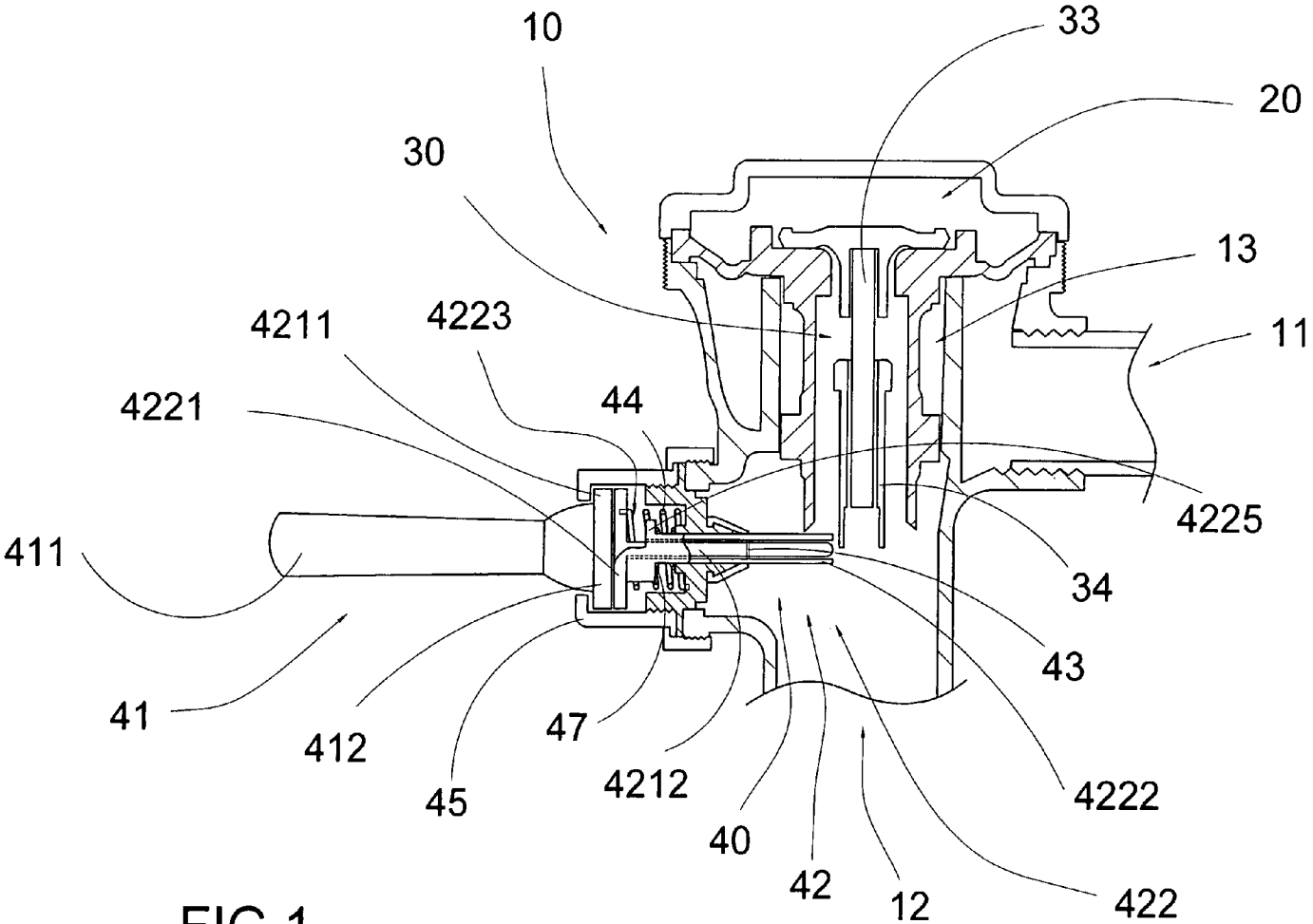
FIG. 1 is a sectional side view of a flush system according to a preferred embodiment of the present invention.

Referring to FIG. 1 to FIG. 6 of the drawings, a flush system according to a preferred embodiment of the present invention is illustrated, in which the flush system for a toilet comprises a valve body 10, a valve seat 20, a flushing shaft 30, and a water control arrangement 40.

The valve body 10 has a water inlet 11 communicating with a water source, a water outlet 12, and a water chamber 13 communicating between the water inlet 11 and the water outlet 12.

The valve seat 20 is supported in the valve body 10 to move between a normal idle position and a flushing position, wherein at the idle position, the valve seat 20 is sealed at the water chamber 13 for retaining a water pressure within the water chamber 13 so as to block flush water flowing from the water inlet 11 to the water outlet 12, wherein and at the flushing position, the valve seat 20 is moved to relief the water pressure for allowing the flush water flowing towards the toilet through the water outlet 12 so as to complete a flushing operation.

The flushing shaft 30 is extended from the valve seat 20 in the valve body 10 for being moved to drive the valve seat 20 to move between the idle position and the flushing position, wherein the flushing shaft 30 defines a lower pushing position 31 as a first position and a higher pushing position 32 as a second position. Furthermore, the flushing shaft 30 comprises a main shaft member 33 and a movable pin 34 movably provided on a lower portion thereof so that the movable pin 33 is capable of longitudinally moving along the flushing shaft 30 with respective to the main shaft member 33.

The flush water control arrangement 40 comprises a flush actuator 41 and a water control pusher 42. The flush actuator 41 comprises an actuator handle 411 movably extended from the valve body 10 for being actuated to activate the flushing operation, wherein the flush actuator 41 is adapted to move between a high volume actuating position and a low volume actuating position.

On the other hand, the water control pusher 42 comprises a low volume pusher member 421 and a high volume pusher member 422 spacedly supported and extended from the flush actuator 41, in such a manner that when the flush actuator 41 is moved to the high volume actuating position, the high volume pusher member 422 is driven to move by the flush actuator 41 to pivotally move the flushing shaft 30 at the higher pushing position 32 for allowing a high volume of water flowing through the valve seat 20, wherein when the flush actuator 41 is moved to the low volume actuating position, the low volume pusher member 421 is driven to move by the flush actuator 41 to pivotally move the flushing shaft 30 at the lower pushing position 31 for allowing a low volume of water flowing through the valve seat 20, thereby a user is able to control a flush volume of the water by actuating the flush actuator 41 between the high volume actuating position and the low volume actuating position. Normally however, the low volume pusher member 421 and the high volume pusher member 422 are spacedly apart from the flushing shaft 30 so as to close the valve seat 20 for blocking water from flowing through the valve body 10.

According to the preferred embodiment of the present invention, the flush actuator 41 further comprises a driving member 412 received within the valve-body 10 and operatively connected with the actuator handle 411, in such a manner that when the flush actuator 41 is in the high volume actuating position, the flush actuator 41 is driven to drive the driving member 412 to push the high volume pusher member 422 of the water control pusher 42. On the other hand, when the flush actuator 41 is in the low volume actuating position, the flush actuator 41 is driven to drive the driving member 412 to push the low volume pusher member 421 of the water control pusher 42.

The high volume pusher member 422 of the water control pusher 42 comprises a biasing head 4221 extended to align with the driving member 412 of the flush actuator 41, and a tubular member 4222 defining a central cavity transversely extended from the biasing head 4221 to align with the higher pushing position 32 for pushing the lower pushing position 31 of the flushing shaft 30 when the flush actuator 41 is driven to move at the high volume actuating position. It is worth mentioning that when the tubular member 4222 is pushed to bias against the flushing shaft 30, the movable pin 34 is arranged to be pushed to move upwardly along the flushing shaft 30 while the main shaft member 33 is pivotally pushed to open the valve seat 20 for allowing a high volume of water flowing through the valve body 10.

In order to precisely control the volume of the water to complete the flushing operation, the time period of the valve seat 20 being stayed at the flushing position should be concerned. In other words, the longer time of the valve seat 20 being stayed at the flushing position, the relatively higher volume of water is used for completing the flushing operation. Therefore, the shorter time of the valve seat 20 being stayed at the flushing position, the relatively lower volume of water is used for completing the flushing operation.

Accordingly, the time period of the valve seat 20 being stayed at the flushing position can be controlled by the time of the flushing shaft 30 being actuated to move back to its vertical orientation. It is worth to mention that when the movable pin 34 of the flushing shaft 30 is moved back to its vertical orientation, the valve seat 20 is sealed back at its idle position to block the water flushing out of the water outlet 12.

Figure 2:
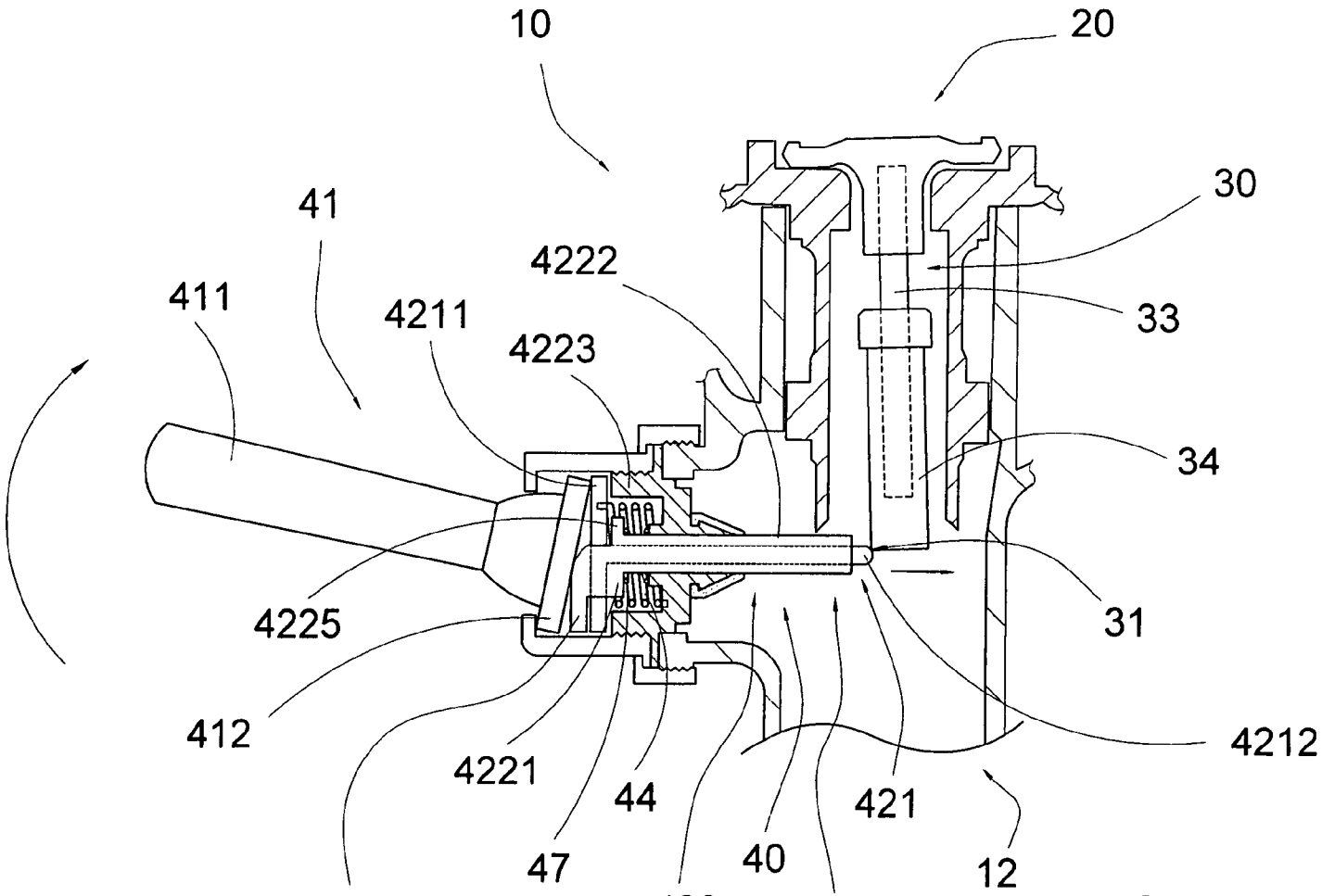
FIG. 2 is another sectional side view of the flush system according to the above preferred embodiment of the present invention, illustrating that the flush actuator is in the low volume actuating position and the flush cycle is about to start.
Figure 3:
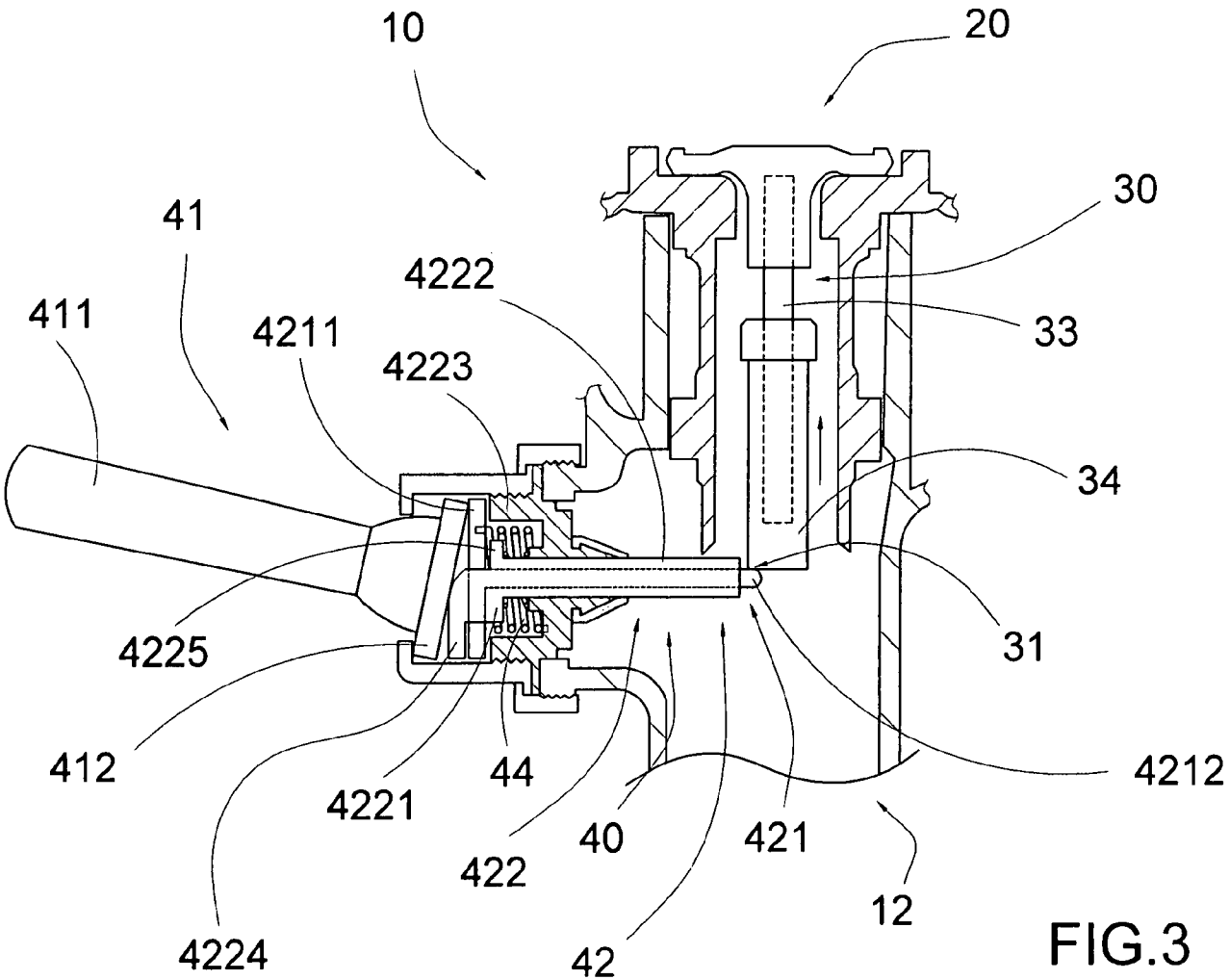
FIG. 3 is another sectional side view of the flush system according to the above preferred embodiment of the present invention, illustrating that the flush actuator is in the low volume actuating position when the flush cycle is started.
Figure 4:
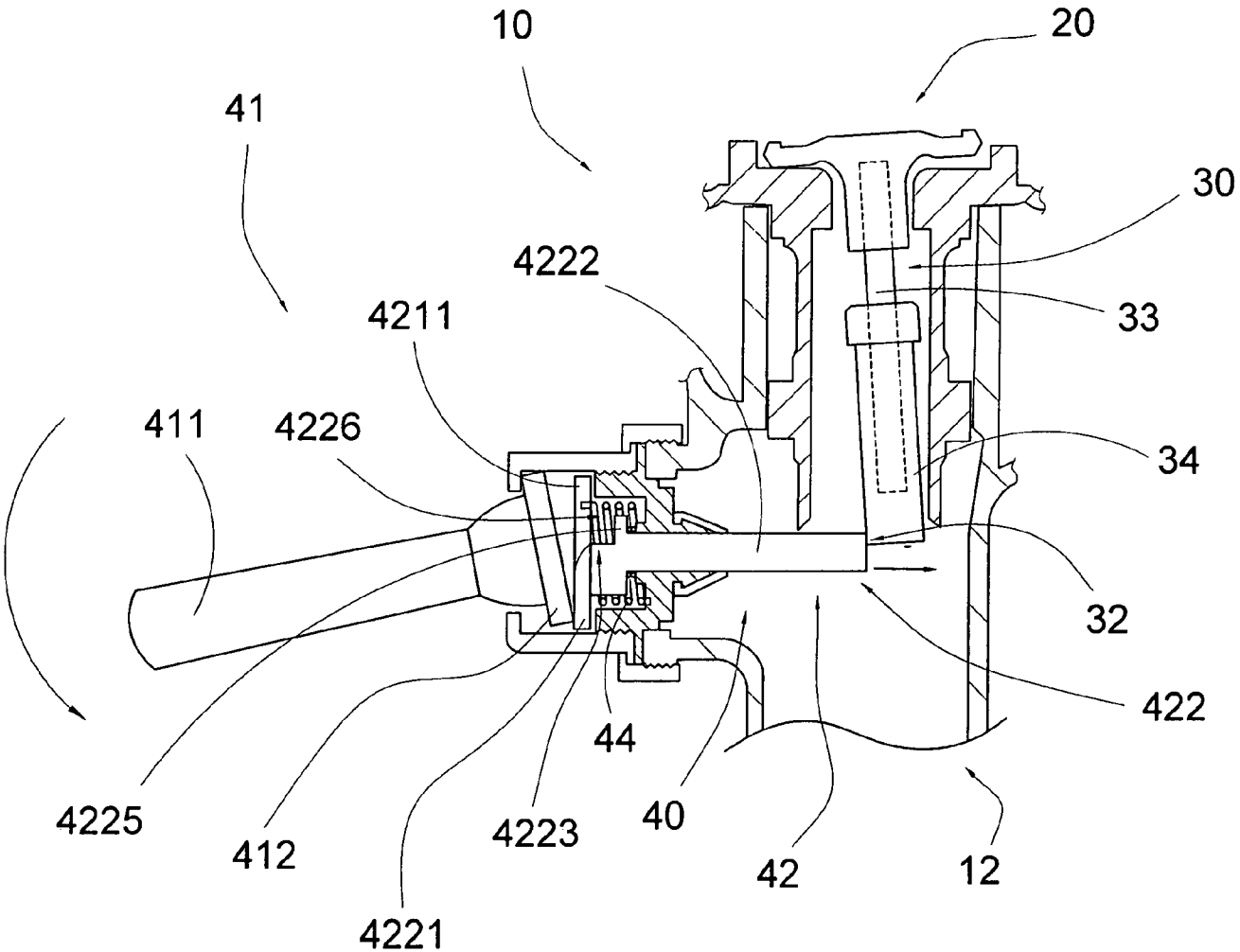
FIG. 4 is another sectional side view of the flush system according to the above preferred embodiment of the present invention, illustrating that the flush actuator is in the high volume actuating position and the flush cycle is about to start.
Figure 5:
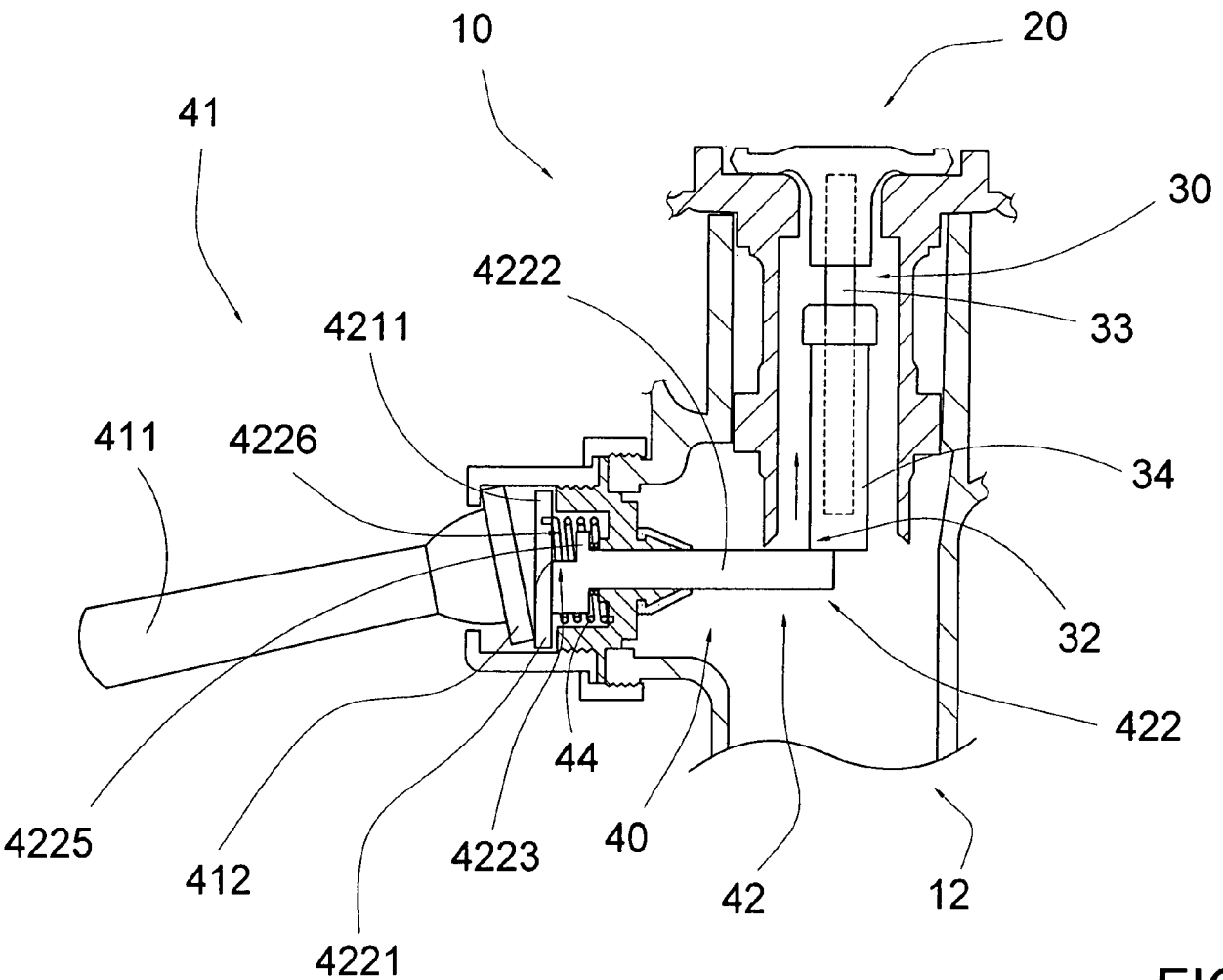
FIG. 5 is another sectional side view of the flush system according to the above preferred embodiment of the present invention, illustrating that the flush actuator is in the high volume actuating position when the flush cycle is started.
Figure 6:
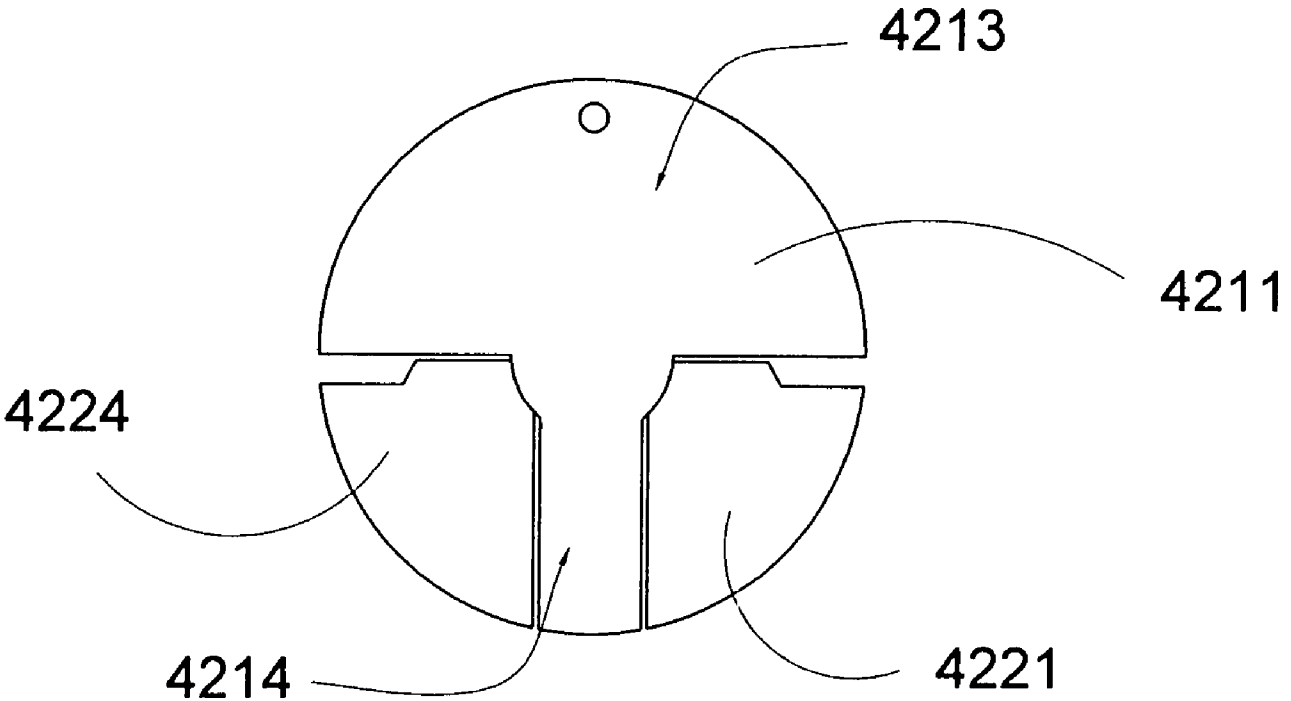
FIG. 6 is a side view of the flush actuator according to the above preferred embodiment of the present invention.

When the high volume pusher member 422 is driven to move by the flush actuator 41 to pivotally move the flushing shaft 30 at the higher pushing position 32, the movable pin 34 requires longer time to return back to its vertical orientation, as shown in FIGS. 4 and 5. When the low volume pusher member 421 is driven to move by the flush actuator 41 to pivotally move the flushing shaft 30 at the lower pushing position 31, the movable pin 34 requires shorter time to return back to its vertical orientation, as shown in FIGS. 2 and 3. Therefore, by actuating one of the low volume pusher member 421 and the high volume pusher member 422, the time period of the movable pin 34 returning back to its vertical, orientation can be controlled so as to control the volume of water for completing the flushing operation.

Another way to precisely control the volume of the water to complete the flushing operation is to control the inclination angle of the flushing shaft 30 being actuated.

According to the preferred embodiment of the present invention, the high volume pusher member 422 is arranged to be longitudinally pushed to bias against the flushing shaft 30 until the movable pin 34 is moved to a position above the high volume pusher member 422. In other words, the flushing shaft 30 is pivotally moved to a high volume flushing angle of inclination with respect to a vertical axis of the flushing shaft 30 so that a time period for which the valve seat 20 is opened is maximized.

On the other hand, the low volume pusher member 421 comprises a pusher head 4211 extended between the driving member 412 of the flush actuator 41 and the high volume pusher member 422, and an elongated pusher pin 4212 transversely extended from the pusher head 4211 to align with the lower pushing position 31 for pushing the lower pushing position 31 of the flushing shaft 30 when the flush actuator 41 is driven to move at the low volume actuating position. It is worth mentioning that the elongated pusher pin 4212 has a circular cross section and is arranged to movably and coaxially disposed into the central cavity of the high volume pusher member 422 such that the low volume pusher member 421 is capable of pushing the lower pushing position 31 of the flushing shaft 30 by longitudinally sliding along the central cavity of the high volume pusher member 422. According to the preferred embodiment of the present invention, the low volume pusher member 421 is arranged to be longitudinally pushed to bias against the flushing shaft 30 until the movable pin 34 is moved to a position above the low volume pusher member 421. In other words, the flushing shaft 30 is pivotally moved to a low volume flushing angle of inclination with respective to a vertical axis of the flushing shaft 30 so that a time period for which the valve seat 20 is less than that when the flushing shaft 30 is pivotally moved to the high volume flushing angle. Since the low volume flushing angle of inclination is less than the high volume flushing angle of inclination, the time period for which the valve seat 20 is opened is less than that when the flushing shaft 30 is pivotally moved to the high volume flushing angle, and the volume of flush water will be accordingly less than when the flushing shaft 30 is pivotally moved to the high volume flushing angle.

Thus, when the higher pushing position 32 of the flushing shaft 30 is longitudinally pushed, a relatively high volume of flush water is allowed to pass through the valve body 10 because there is an extended time of opening of the valve seat 20. When the lower pushing position 31 of the flushing shaft 30 is longitudinally pushed, a relatively low volume of flush water is allowed to pass through the valve body 10 because the time of which the valve seat 20 is opened is less than that when the higher pushing position 31 of the flushing shaft 30 is pushed.

It is important to mention that when the high volume pusher member 422 is pushed by the driving member 412, the driving member 412 is arranged to push both the low volume pusher member 421 and the high volume pusher member 422 for driving them to move longitudinally toward the flushing shaft 30.

Accordingly, the pusher head 4211 of the low volume pusher member 421 has a top semi-circular portion 4213 and a lower transverse portion 4214 extended from the semi-circular portion 4213, wherein the when the flush actuator 41 is moved to the low volume actuating position, the driving member 412 is arranged to push the semi-circular portion 4213 of the low volume pusher member 421 so as to push the elongated pusher pin 4212 to bias against the flushing shaft 30.

On the other hand, the biasing head 4221 of the high volume pusher member 422 comprises a pusher seat 4223 having two spacedly apart biasing members 4224 and a blocking member 4225 spacedly formed from the two biasing members 4224 to define a pusher cavity 4226 between the two biasing members 4224 and the blocking member 4225, wherein when the flush actuator 41 is moved to the high volume actuating position, the driving member 412 is arranged to push the biasing members 4224 so as to push the elongated tubular member 4222 to bias against the flushing shaft 30. It is worth mentioning that the pusher head 4211 of the high volume pusher member 422 is capable of longitudinally moving in the pusher cavity 4226 so that a distance by which the pusher head 4211 can be longitudinally moved in the valve body 10 is dictated by a longitudinal length of the pusher cavity 4226 (i.e. the longitudinal distance between the biasing members 4224 and the blocking member 4225).

Figure 9A:
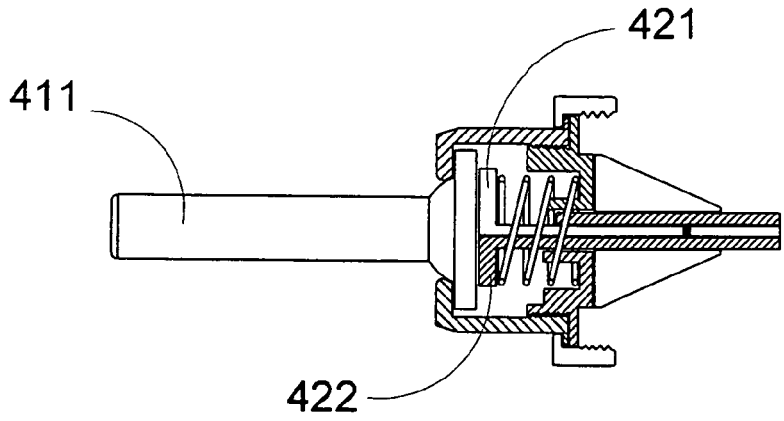
FIGS. 9A to 9C illustrate the actuator handle of the flush water control arrangement and its alternative modes according to the above preferred embodiment of the present invention.
Figure 9B:
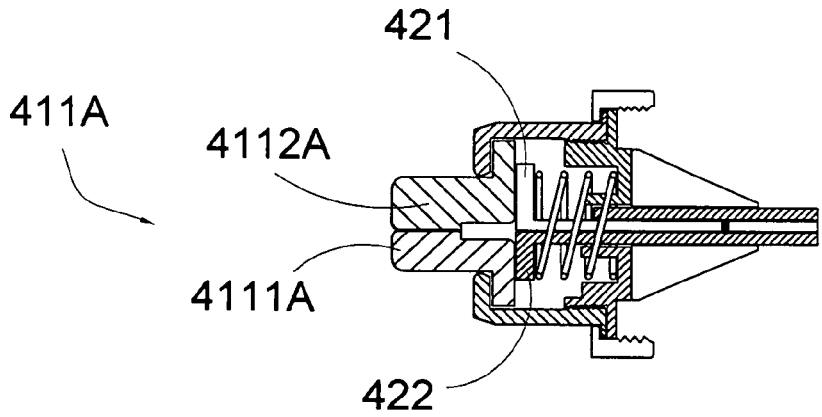
Figure 9C:
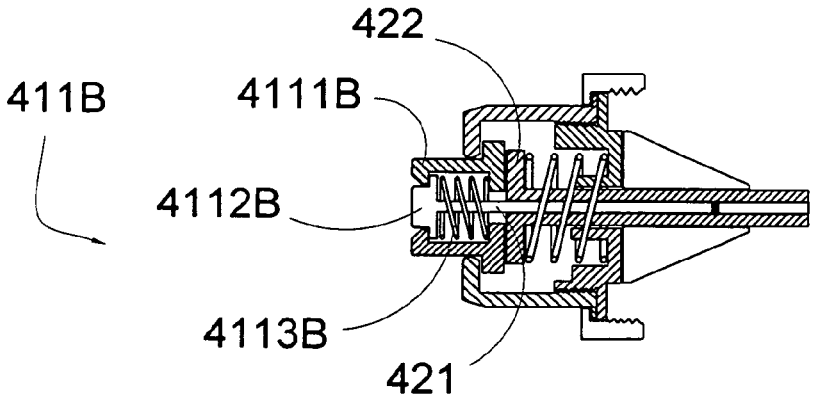

Accordingly, the lower transverse portion 4214 is integrally extended from the semi-circular portion 4213 such that when the actuator handle 411 is actuated to push at the biasing members 4224 for moving the high volume pusher member 422, the actuator handle 411 will also push at the lower transverse portion 4214 for moving the low volume pusher 421 at the same time. Therefore, both the low and high volume pusher members 421, 422 will be moved at the same time to complete the high volume flushing operation. It is worth to mention that the lower transverse portion 4214 can be omitted, as shown in FIG. 9A, such that when the actuator handle 411 is actuated, only the high volume pusher member 422 is pushed to complete the high volume flushing operation while the low volume pusher member 421 is remained at its original position without being pushed.

Figure 7:
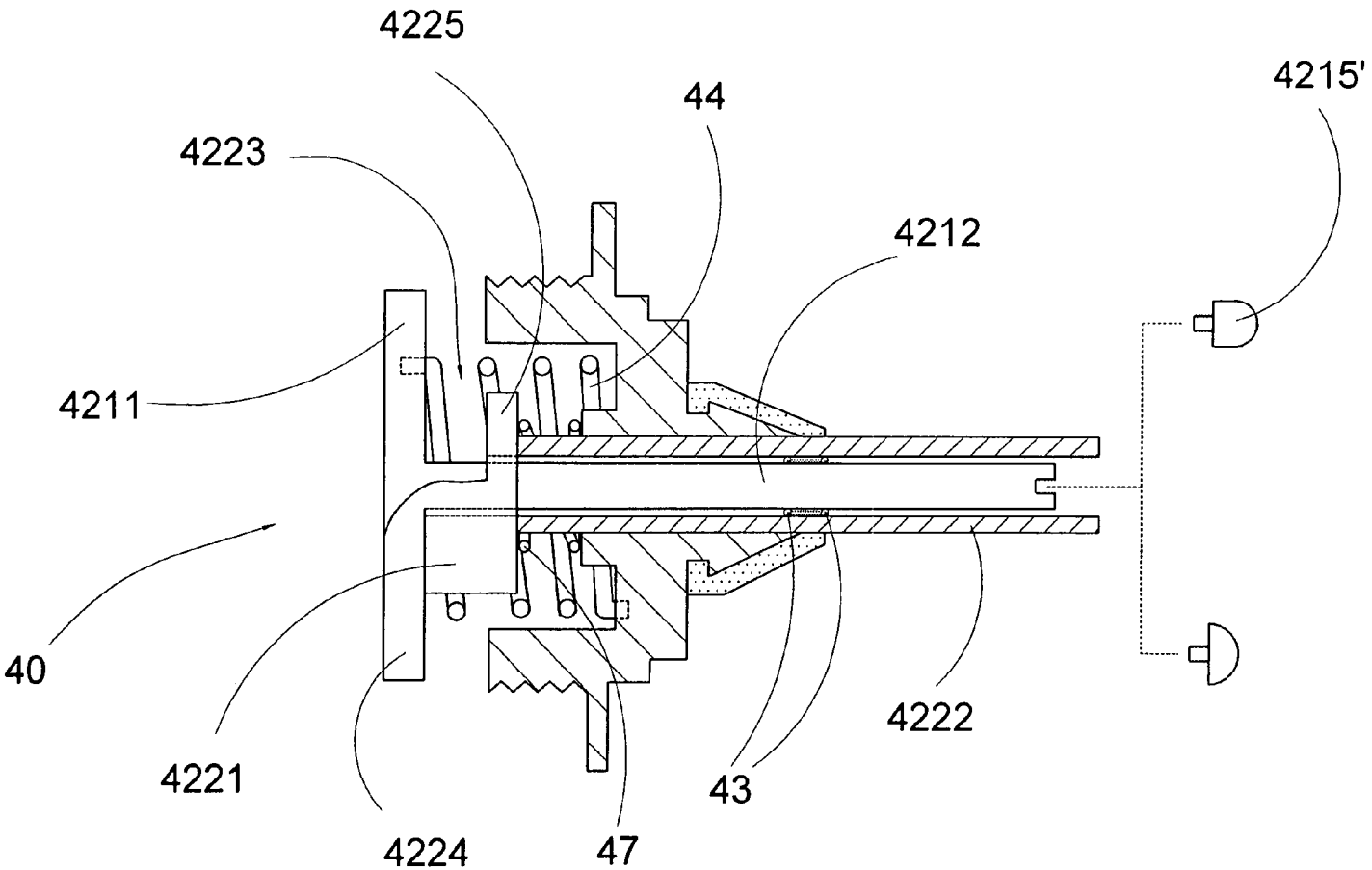
FIG. 7 is a first alternative mode of the flush system according to the above preferred embodiment of the present invention.

The water control arrangement 40 further comprises a sealing ring 43 received within the high volume pusher member 422 for preventing backflow of flush water from within the valve body 10 to the flush actuator 41. As shown in FIG. 7, two spaced apart sealing rings 43 are mounted between the outer surface of the low volume pusher member 421 and the inner surface of the high volume pusher member 422, wherein lubricant is applied at the outer surface of the low volume pusher member 421 between the two sealing rings 43 to ensure the smooth sliding movement of the low volume pusher member 421 within the high volume pusher member 422 and to seal the gap between the outer surface of the low volume pusher member 421 and the inner surface of the high volume pusher member 422.

Moreover, the water control arrangement 40 further comprises a resilient element 44 as an outer resilient element provided in the pusher cavity 4226 for normally applying an urging force to the low volume pusher member 421 and the high volume pusher member 422 for restoring a position thereof so as to normally keep the low volume pusher member 421 and the high pusher member 422 to be spacedly apart from the flushing shaft 30.

As shown in FIGS. 1 and 7, the water control arrangement 40 further comprises an inner resilient element 47 provided in the pusher cavity 4226 for applying an urging force to the high volume pusher member 422 only so as to normally keep the high volume pusher member 422 in an idle position when the low volume pusher 421 is actuated. Accordingly, the outer and inner resilient elements 44, 47 are two compression springs, wherein a diameter of the outer resilient element 44 is larger than a diameter of the inner resilient element 47.

When the actuator handle 411 is moved to actuate the high volume pusher member 422, both the low and high volume pusher members 421, 422 are driven to move. When the actuator handle 411 is moved to actuate the low volume pusher member 421, the inner resilient element 47 will push against the high volume pusher member 422 to keep the high volume pusher member 422 at its original position. In other words, the inner resilient element 47 ensures only the low volume flushing operation being completed when only the low high pusher member 421 is actuated.

It is worth mentioning that according to the preferred embodiment of the present invention, the actuator handle 411 is adapted to move upwardly and downwardly with respective to the valve body 10 in order to actuate the flush operation for having either the high volume of flush water or the low volume of flush water. However, one having ordinary skill in the art must appreciate that the direction of actuation for the actuator handle 411 can also be forward or backward with respective to the valve body 10.

The operation of the present invention is as follows: a user is free to actuate the actuator handle 411 upwardly or downwardly for driving the driving member to bias against the low volume pusher member 421 or the high volume pusher member 422. When the low volume pusher member 421 is pushed, the flushing shaft 30 is pushed at the lower pushing position 31 so as to release a relatively low volume of flush water. On the other hand, when the high volume pusher member 422 is pushed, the flushing shaft 30 is pushed at the higher pushing position 32 so as to release a relatively high volume of flush water.

Referring to FIG. 7 of the drawings, a first alternative mode of the flush system according to the preferred embodiment of the present invention is illustrated. The first alternative mode is similar to the preferred embodiment except the low volume pusher member 421' further comprises a supplemental pusher member 4215' attached onto an outer end of the elongated pusher pin 4212, so that by adjusting a size of the supplemental pusher member 4215', the time opening the valve seat 20 can be optimally adjusted. For example, when the size of the supplemental pusher member 4125' is smaller than the size of the elongated pusher pin 4212, the time for releasing the valve seat 20 can further be reduced so as to further reduce the flow of the flush water.

Figure 8:
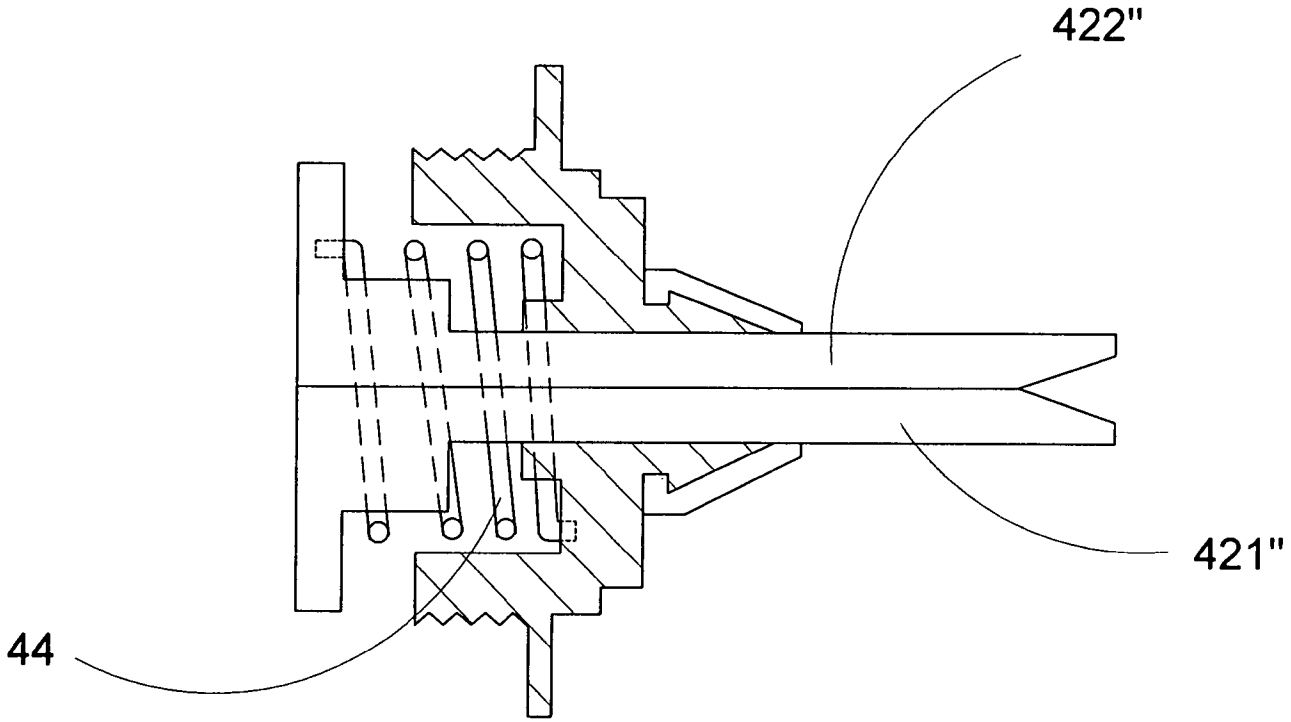
FIG. 8 is a second alternative mode of the flush system according to the above preferred embodiment of the present invention.

Referring to FIG. 8 of the drawings, a second alternative mode of the flush system according to the preferred embodiment of the present invention is illustrated. The alternative mode is similar to the preferred embodiment except the low volume pusher member 421" and the high volume pusher member 422". According to the alternative mode, each of the low volume pusher member 421" and the high volume pusher member 422" is an elongated member, wherein the low volume pusher member 421" and the high volume pusher member 422" are slidably supported within the valve body 10 in a side-by-side manner for being driven to move for pushing the lower pushing position 31 and the higher pushing position 32 respectively.

FIGS. 9 to 14 illustrate the actuator handle 411 of the flush water control arrangement 40 and its alternative modes according to the above preferred embodiment of the present invention.

Figure 10A:
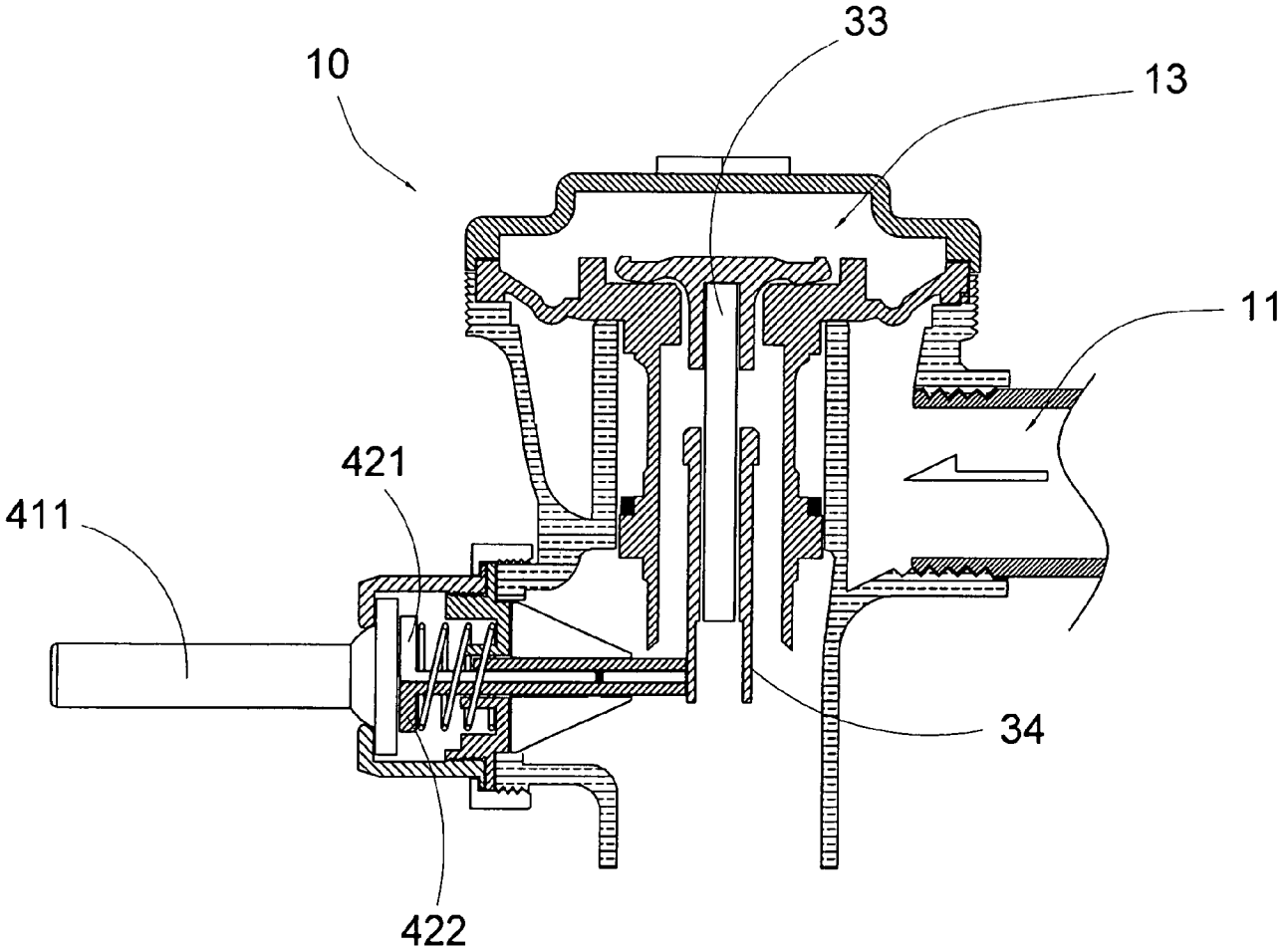
FIGS. 10A to 10C illustrate the actuator handle and its alternative modes mounted to the valve body according to, the above preferred embodiment of the present invention.
Figure 10B:
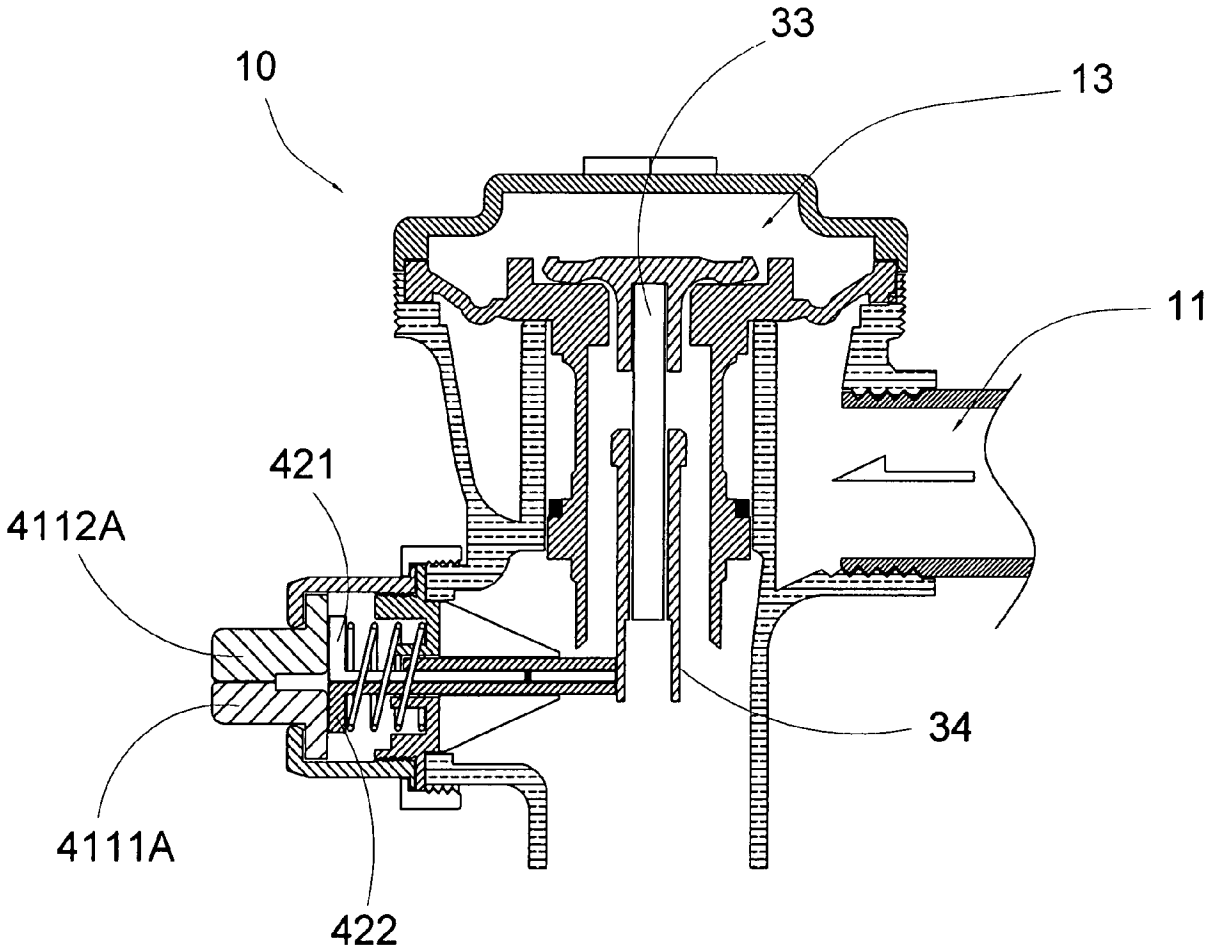
Figure 10C:
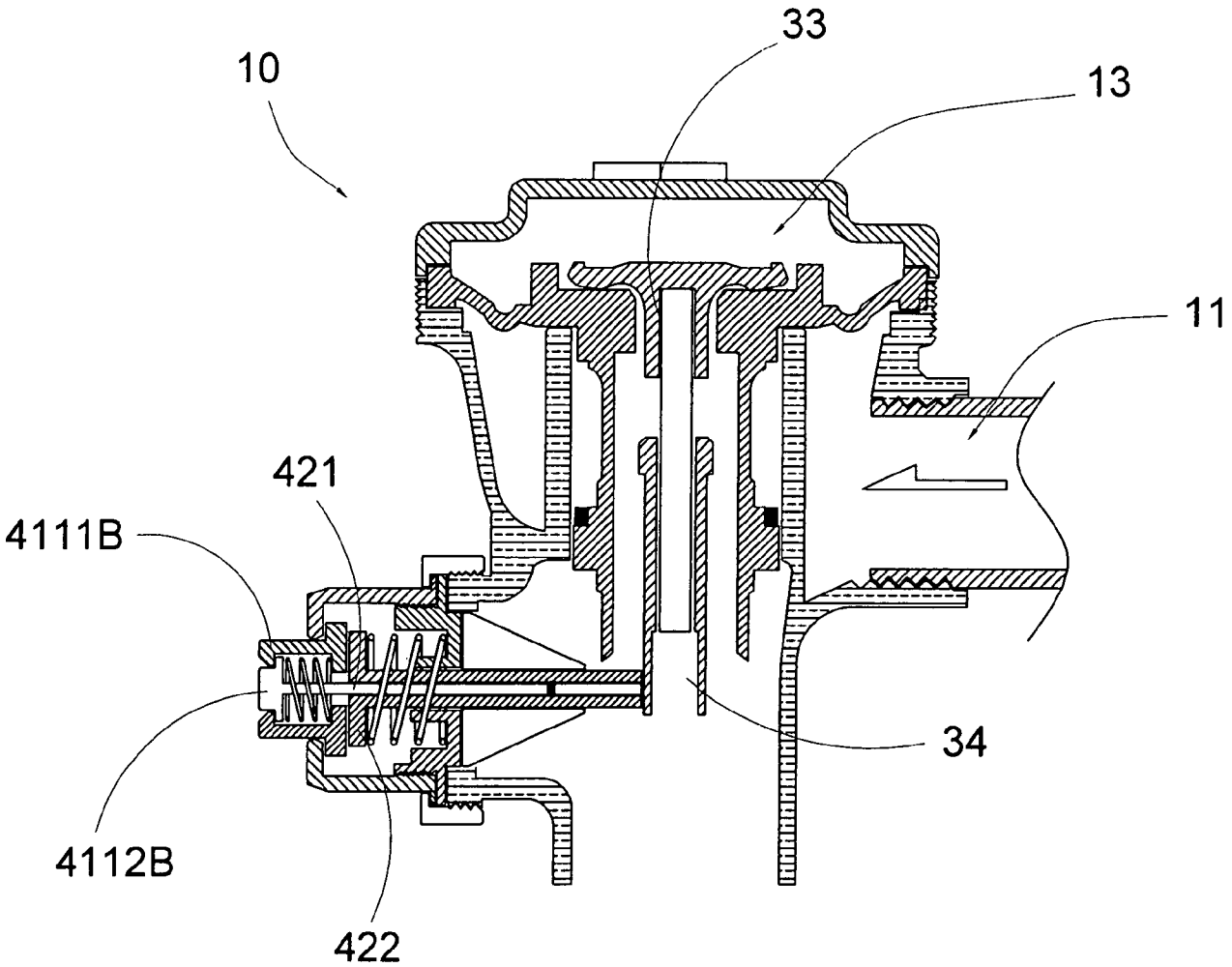
Figure 11A:
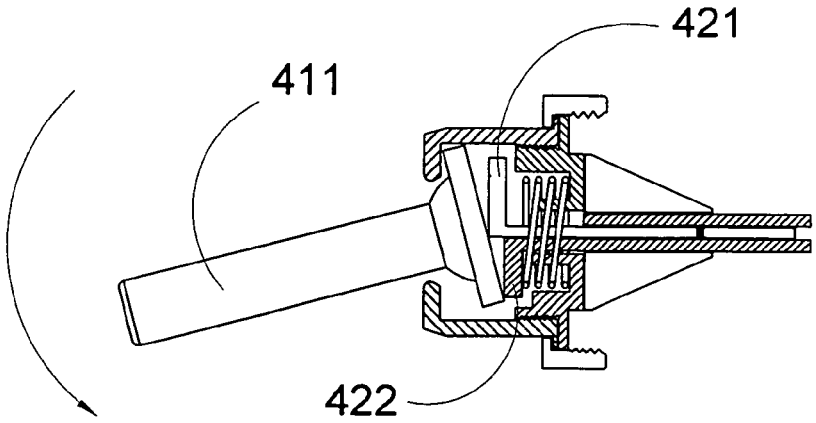
FIGS. 11A to 11C illustrate the actuator handle and its alternative modes being actuated for high volume flush operation according to the above preferred embodiment of the present invention.
Figure 12A:
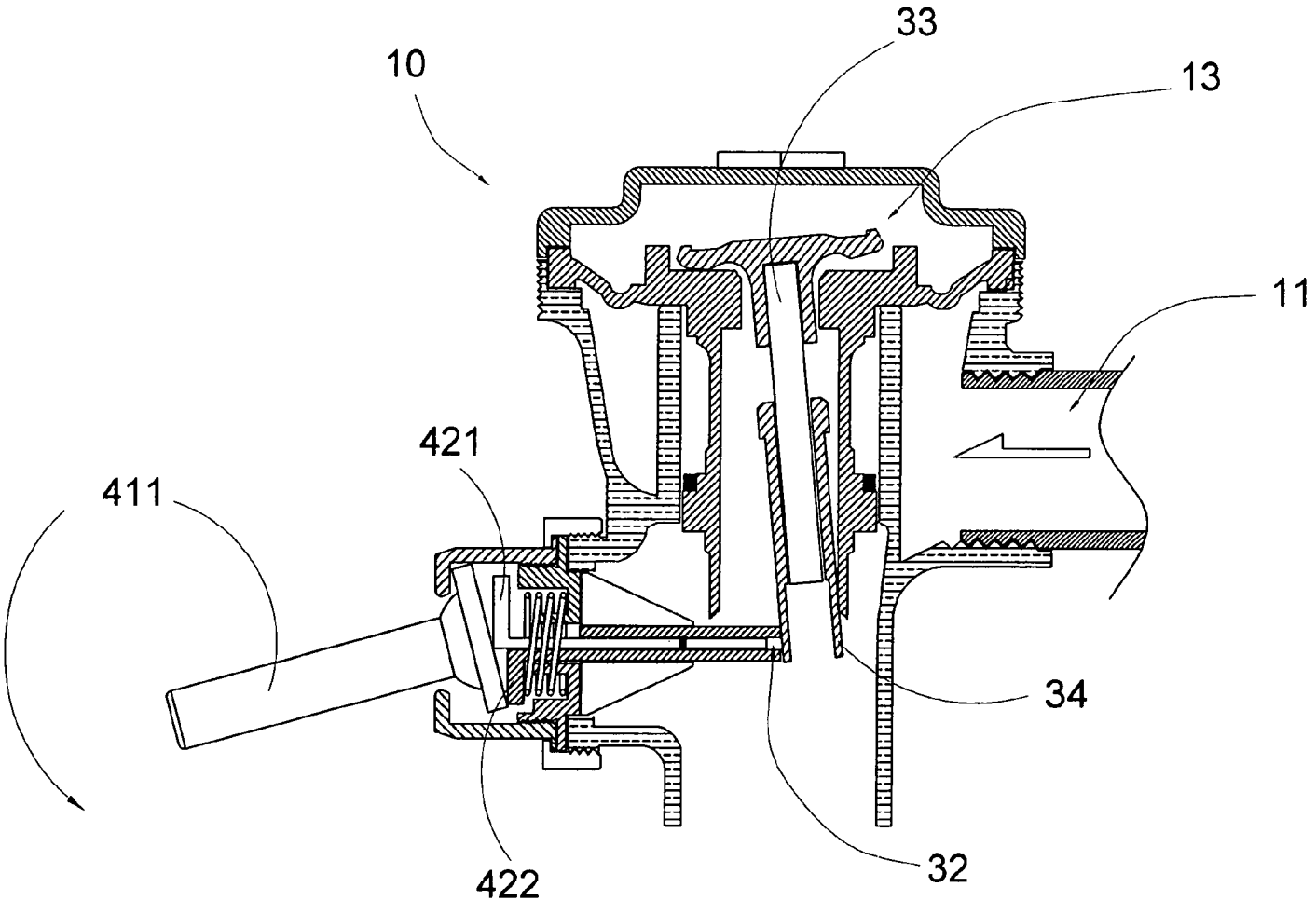
FIGS. 12A to 12C illustrate the actuator handle and its alternative modes mounted to the valve body for high volume flush operation according to the above preferred embodiment of the present invention.
Figure 13A:
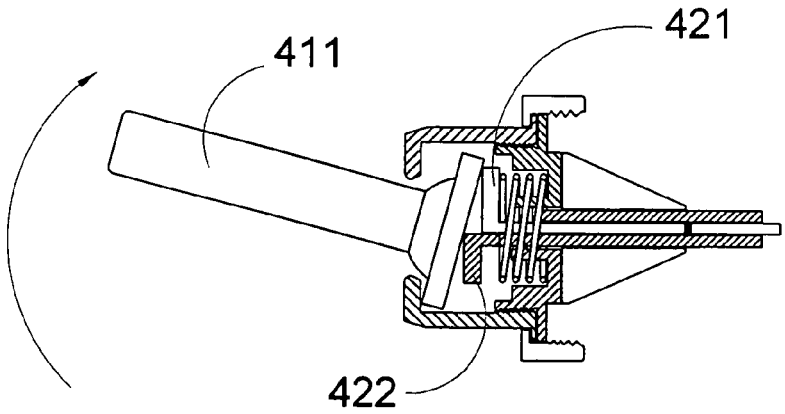
FIGS. 13A to 13C illustrate the actuator handle and its alternative modes being actuated for low volume flush operation according to the above preferred embodiment of the present invention.
Figure 14A:
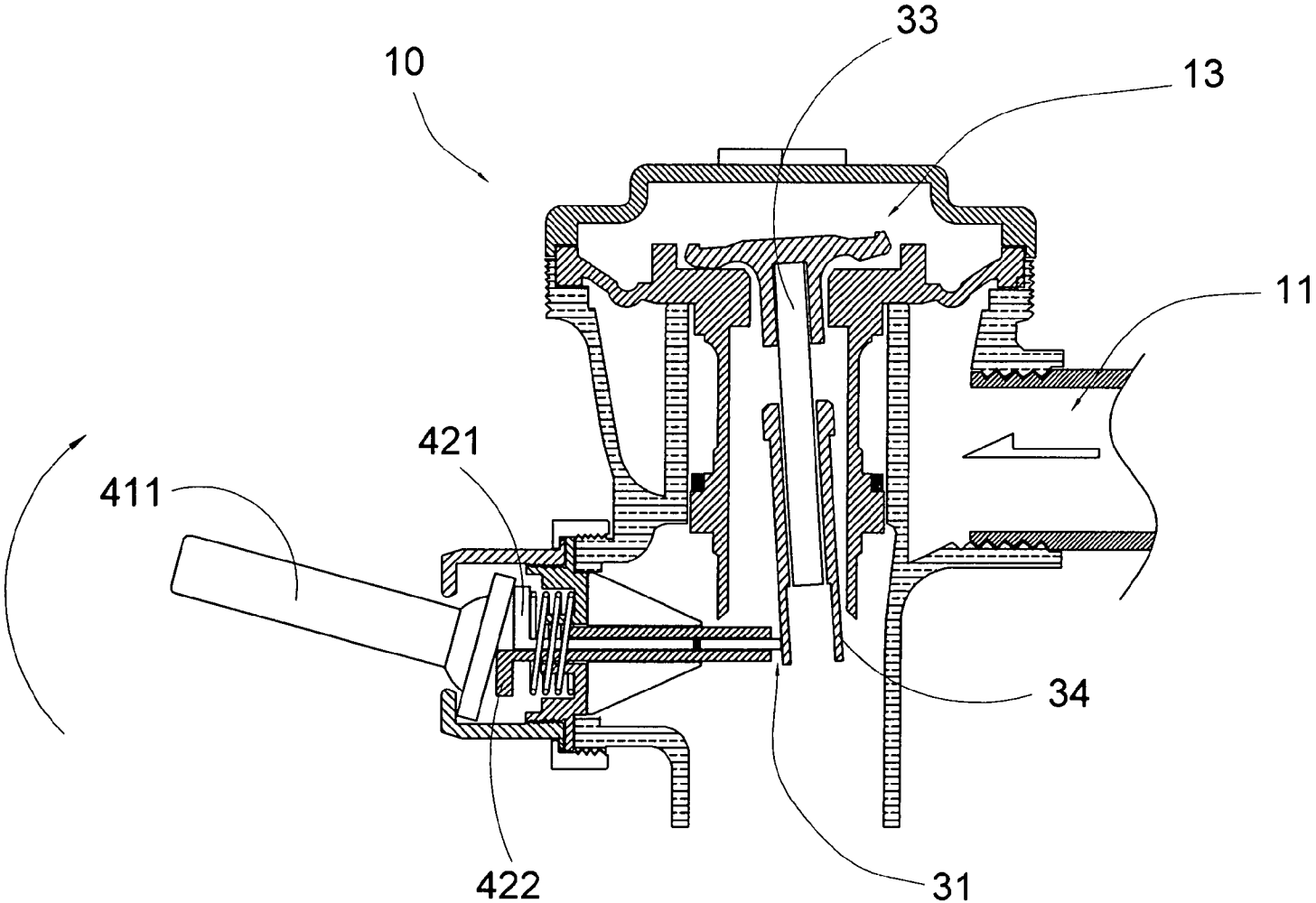
FIGS. 14A to 14C illustrate the actuator handle and its alternative modes mounted to the valve body for low volume flush operation according to the above preferred embodiment of the present invention.
Figure 16:
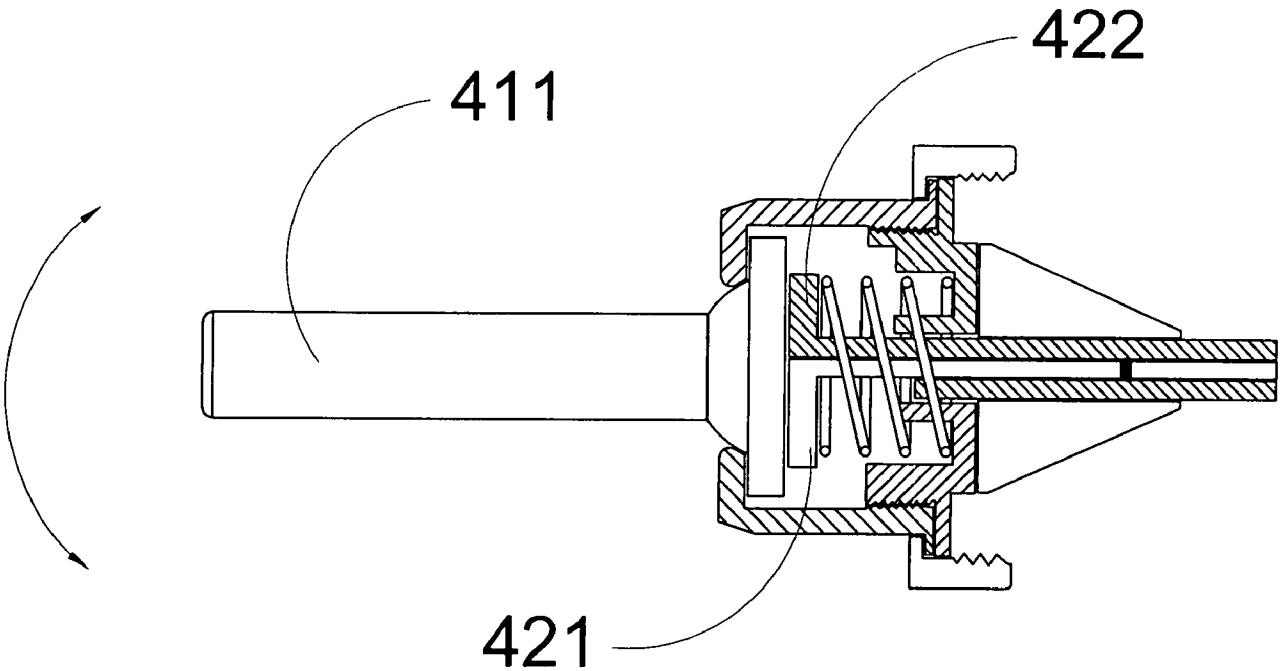
FIG. 16 illustrates the modification of the manual handle to change the actuation direction to its high and low volume actuating position.

As shown in FIG. 9A, 10A, 11A, 12A, 13A, and 14A, the actuator handle 411 is the manual handle manually moved through an arc-path at its idle position to the high volume actuating position or the low volume actuating position. Accordingly, FIGS. 9A and 10A illustrate the manual handle at its idle position. FIGS. 11A and 12A illustrate the manual handle at its high volume actuating position. FIGS. 13A and 14A illustrate the manual handle at its low volume actuating position. It is appreciated that the actuator handle 411 can be pivotally moved downward to its high volume actuating position as shown in FIGS. 11A and 12A. Likewise, it is appreciated that the actuator handle 411 can be pivotally moved upward to its low volume actuating position as shown in FIGS. 13A and 14A. The modification of the manual handle is obvious to change the actuation direction to its high and low volume actuating position, as shown in FIG. 16. In other words, by self-rotating the flush water control arrangement 40 at 180° with respect to the valve body 10, the actuator handle 411 can be pivotally moved upward to its high volume actuating position while the actuator handle 411 can be pivotally moved downward to its low volume actuating position.

It is worth to mention that the low volume pusher member 421 and the high volume pusher member 422 are individually moved by the actuator handle 411. In other words, the high volume flushing operation is completed when only the high volume pusher member 422 is driven to move while the low volume flushing operation is completed when only the low volume pusher member 421 is driven to move.

Figure 11B:
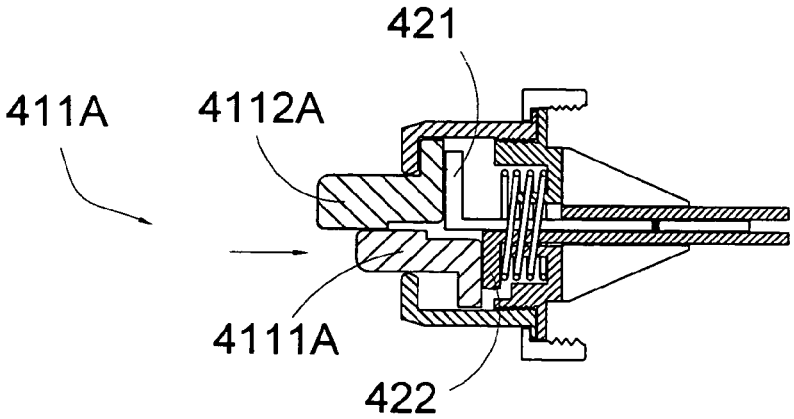
Figure 12B:
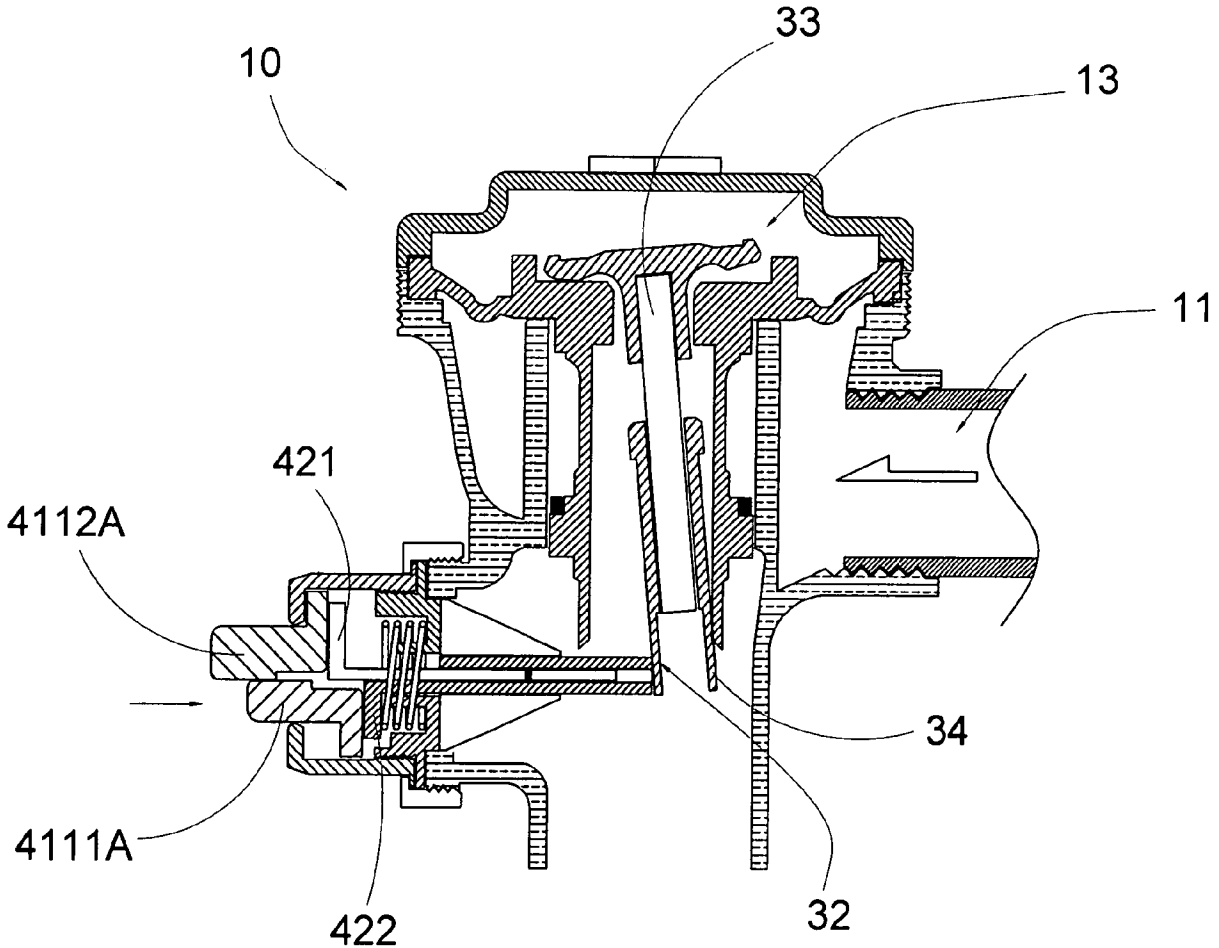
Figure 13B:
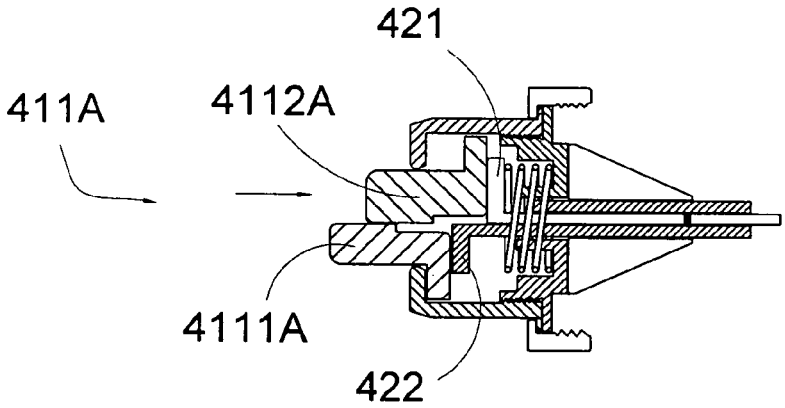
Figure 14B:
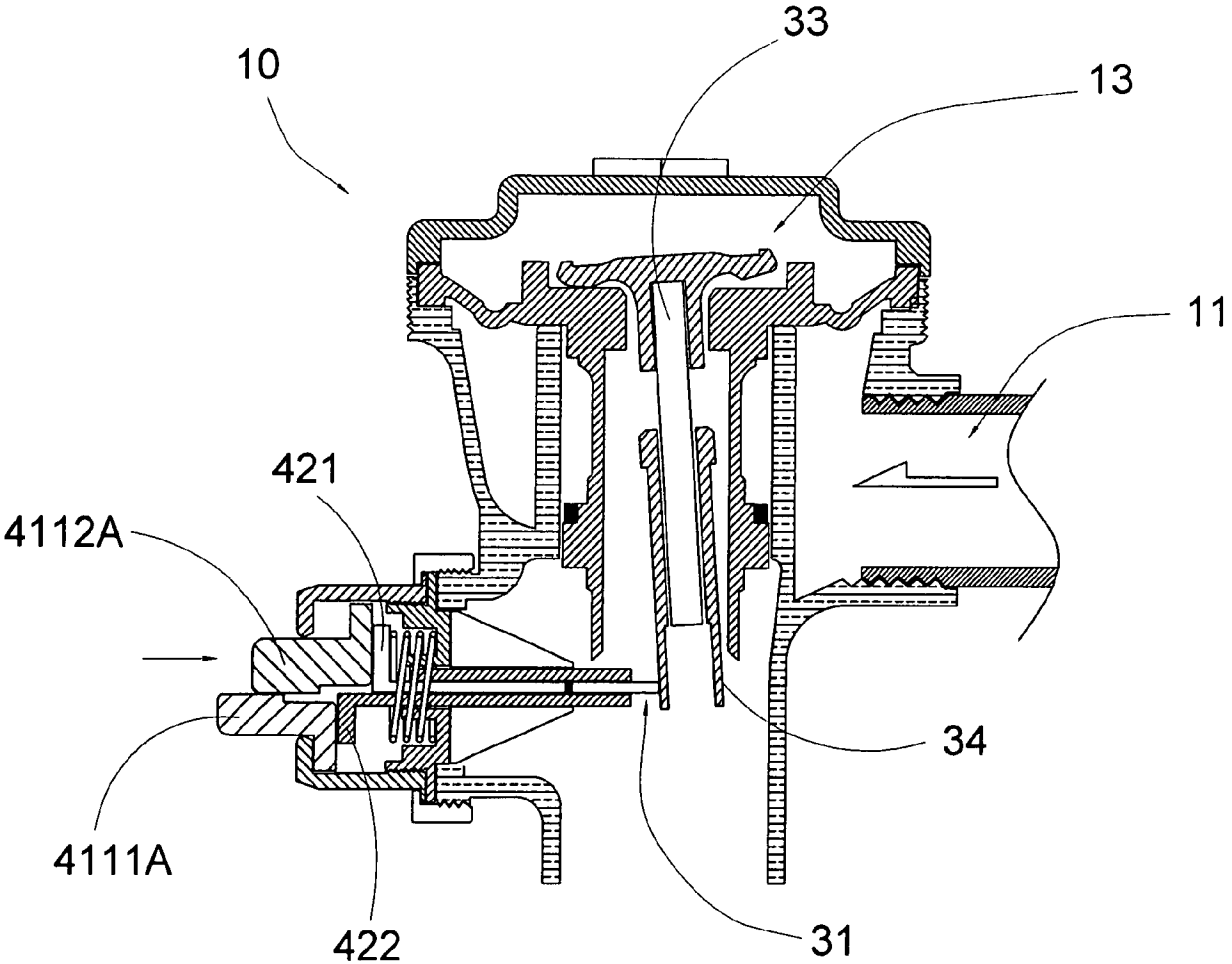

FIGS. 9B, 10B, 11B, 12B, 13B, and 14B illustrate a first alternative mode of the actuator handle 411A, wherein the actuator handle 411A comprises a lower button 4111A and an upper button 4112A. Accordingly, the lower and upper buttons 4111A, 4112A are two half-buttons. The lower button 4111A is manually pressed to drive the high volume pusher member 422 towards the higher pushing position 32 of the flushing shaft 30, as shown in FIGS. 11B and 12B. The upper button 4112A is manually pressed to drive the low volume pusher member 421 towards the lower pushing position 31 of the flushing shaft 30, as shown in FIGS. 13B and 14B. Therefore, instead of pivotally moving the manual handle up and down, the user is able to selectively press one of the lower and upper buttons 4111A, 4112A to select the high and low volume flushing operations.

FIGS. 9C, 10C, 11C, 12C, 13C, and 14C illustrate a second alternative mode of the actuator handle 411B, wherein the actuator handle 411B comprises an outer button 4111B and an inner button 4112B. Accordingly, the outer button 4111B has a hollow shape for the inner button 4112B slidably disposed therein, wherein the user is able to selectively press one of the outer and inner buttons 4111B, 4112B for completing the flushing operation. A compression spring 4113B is disposed in the outer button 4111B for applying an urging force between the outer and inner buttons 4111B, 4112B.

Figure 11C:
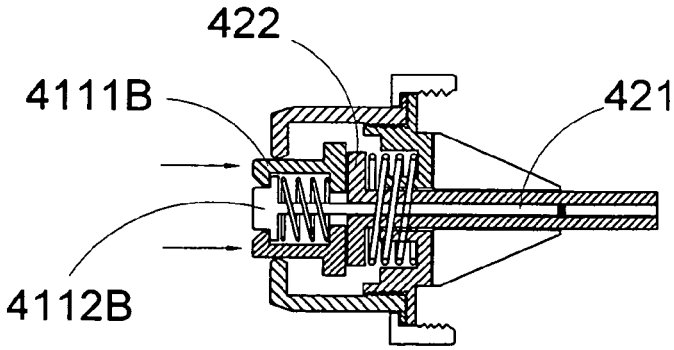
Figure 12C:
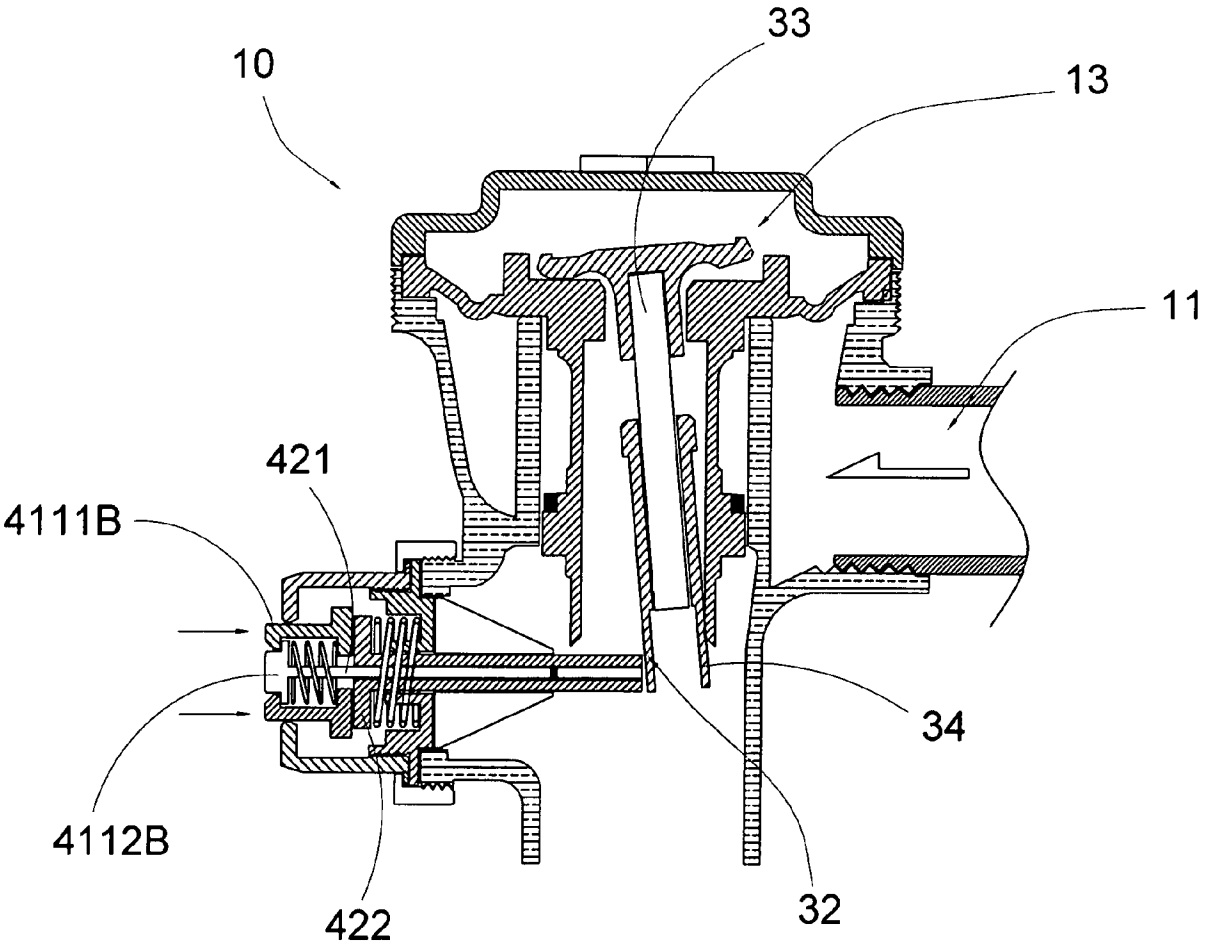
Figure 13C:
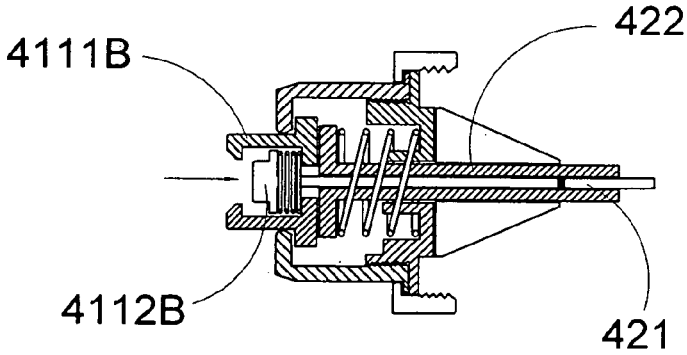
Figure 14C:
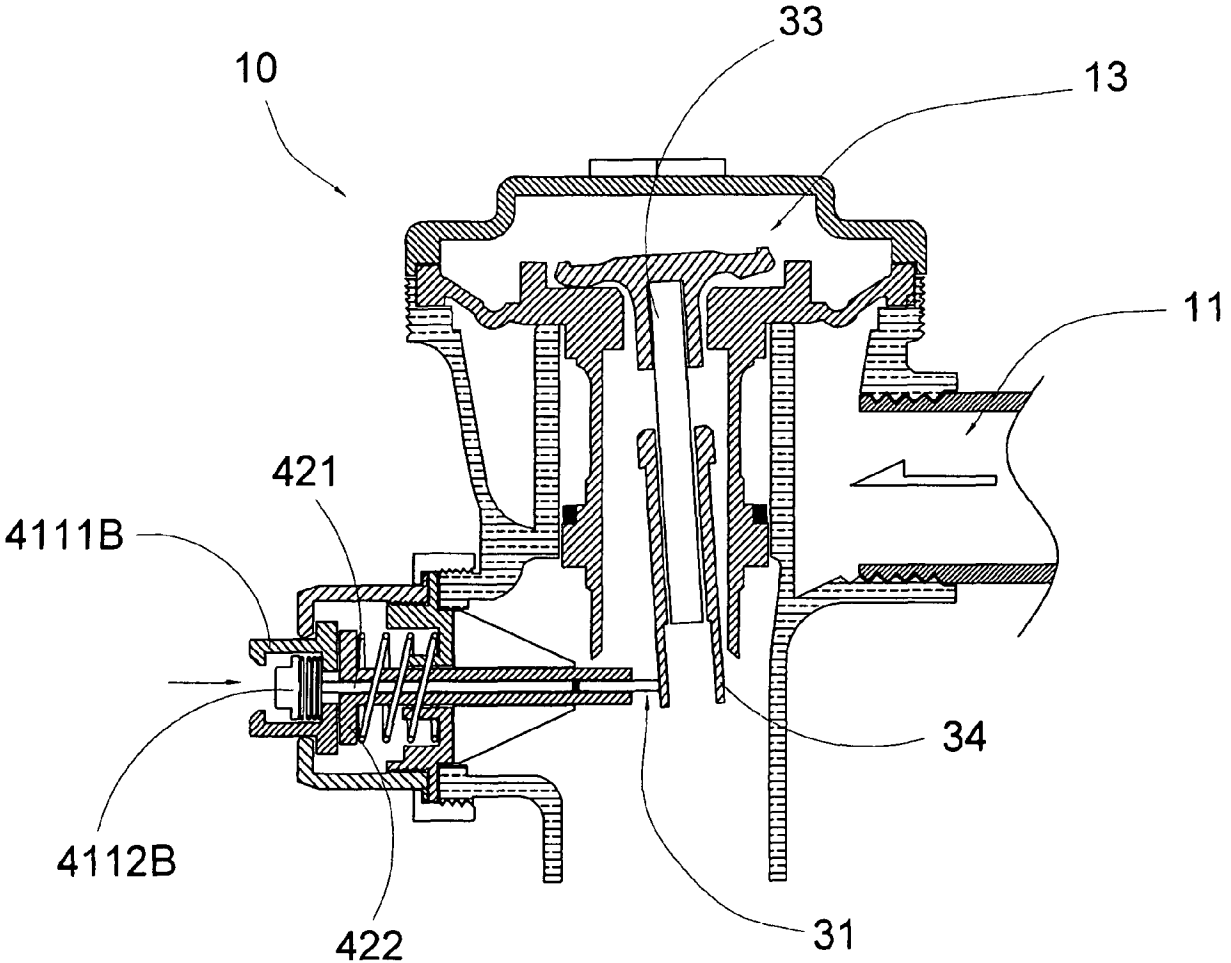

In particularly, the outer button 4111B is manually pressed to drive the high volume pusher member 422 towards the higher pushing position 32 of the flushing shaft 30, as shown in FIGS. 11C and 12C. The inner button 4112B is manually pressed to drive the low volume pusher member 421 towards the lower pushing position 31 of the flushing shaft 30, as shown in FIGS. 13C and 14C. In addition, the inner button 4112B can be integrated with the low volume pusher member 421. It is worth to mention that when the outer button 4111B is pressed, the inner button 4112B is also driven to be pressed at the same time such that the low and high volume pusher members 421, 422 are driven to move at the same time. However, the high volume flushing operation is completed when both the low and high volume pusher members 421, 422 are driven to move at the same time.

Figure 15:
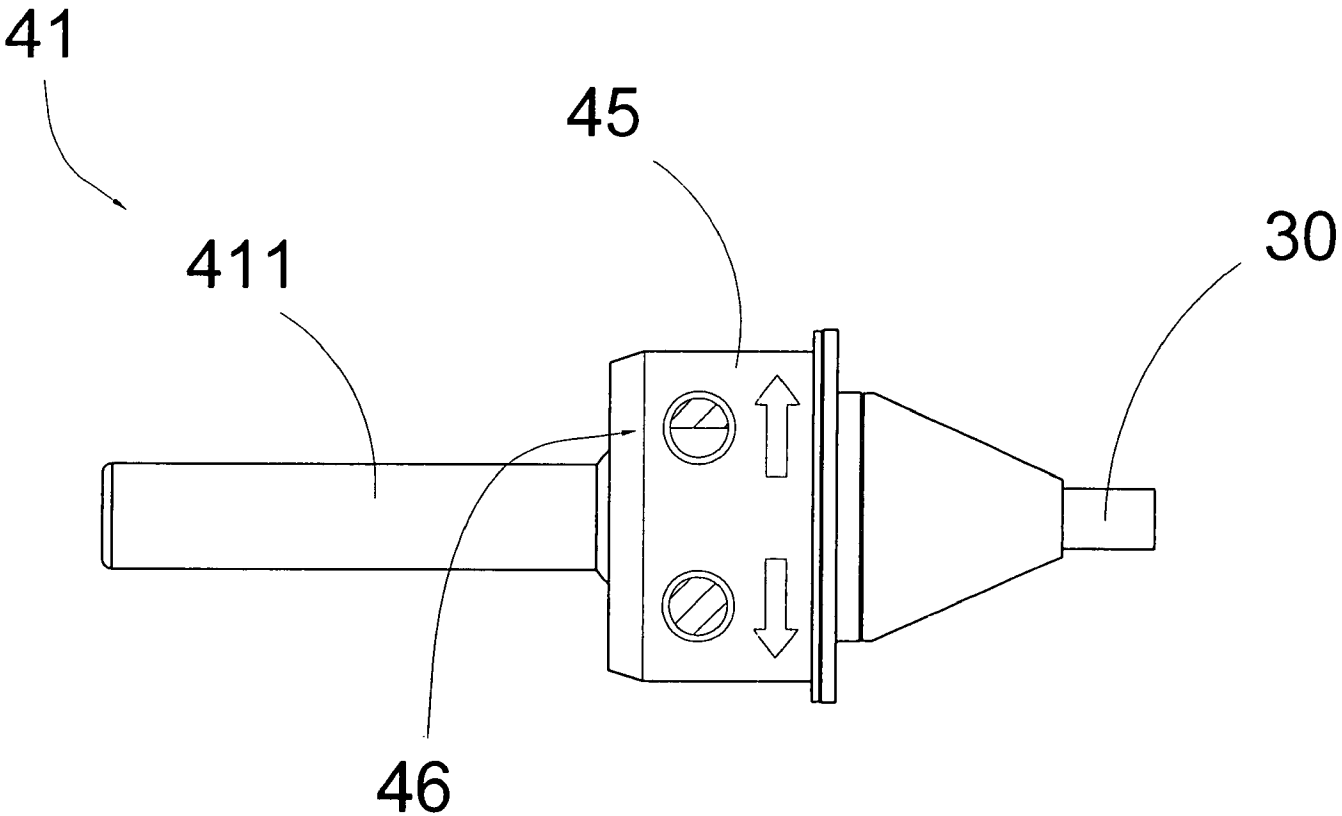
FIG. 15 illustrates a flush indicator of the flush water control arrangement according to the above preferred embodiment of the present invention.

As shown in FIGS. 1 and 15, the flush water control arrangement 40 further comprises a locking ring 45 detachably locking the flush actuator 41 at the opening of the valve body 10 in a movable manner, and a flush indicator 46 provided on the locking ring 45 to indicate the direction of the flush actuator 41 between the high volume actuating position and the low volume actuating position. As shown in FIG. 15, when the actuator handle 411 of the flush actuator 41 is remained at a horizontal orientation, the valve seat 20 is remained at the idle position. The flush indicator 46 contains a low flush indication and a high flush indication located below the low flush indication. Therefore, when the actuator handle 411 of the flush actuator 41 is moved upwardly towards the low flush indication, the flushing operation with low volume of water is completed. When the actuator handle 411 of the flush actuator 41 is moved downwardly towards the high flush indication, the flushing operation with high volume of water is completed.

According to the preferred embodiment of the present invention, the present invention also provides a method of actuating a flush system. The flush system comprises a valve body 10, a valve seat 20 and a flushing shaft 30 extended from the valve seat 20, wherein the method comprises the steps of:

(a) providing a flush actuator 41 comprising an actuator handle 411 movably extended from the valve body 10 for being actuated to activate the flushing operation, wherein the flush actuator 41 is adapted to move between a high volume actuating position and a low volume actuating position;

(b) providing a water control pusher 42 comprising a low volume pusher member 421 and a high volume pusher member 422 spacedly supported and extended from the flush actuator 41; and (c) actuating the flushing actuator 41 in such a manner that when the flush actuator 41 is moved to the high volume actuating position, the high volume pusher member 422 is driven to move by the flush actuator 41 to pivotally move the flushing shaft 30 at the higher pushing position 32 for allowing a high volume of water flowing through the valve seat 20, wherein when the flush actuator 41 is moved to the low volume actuating position, the low volume pusher member 421 is driven to move by the flush actuator 41 to pivotally move the flushing shaft 30 at the lower pushing position 31 for allowing a low volume of water flowing through the valve seat 20, so that a user is able to control a flush volume of the water by actuating the flush actuator 41 between the high volume actuating position and the low volume actuating position.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A flush system, comprising: a valve body having a water inlet and a water outlet; a valve seat supported in said valve body between said water inlet and said water outlet, wherein said valve seat is adapted to move between a normal idle position that water is blocked to flow from said water inlet to said water outlet and a flushing position that said water is allowed to flow from said water inlet to said water outlet so as to complete a flushing operation; a flushing shaft extended from said valve seat to move said valve seat between said idle position and said flushing position, wherein said flushing shaft defines a first position and a second position; and a flush water control arrangement, which comprises: a flush actuator movably coupled with said valve body; and a water control pusher comprising a low volume pusher member and a high volume pusher member alignedly extended towards said first position and said second position of said flushing shaft respectively, wherein said flush actuator is selectively actuated one of said low volume pusher member and said high volume pusher member to complete said flushing operation, wherein said high volume pusher member is actuated to push at said second position of said flushing shaft to complete said flushing operation with a relatively high volume of water, wherein said low volume pusher member is actuated to push at said first position of said flushing shaft to complete said flushing operation with a relatively low volume of water.

2. The flush system, as recited in claim 1, wherein said low volume pusher member is actuated to push at said first position of said flushing shaft for retaining a time period of opening of said valve seat to complete each said flushing operation, wherein said high volume pusher member is actuated to push at said second position of said flushing shaft for prolonging the time period of said opening of said valve seat so as to increase said volume of water for each said flushing operation.

3. The flush system, as recited in claim 2, wherein said high volume pusher member comprises a biasing head and an elongated member which is extended from said biasing head to align with said second position of said flushing shaft and is arranged in such a manner that when said flush actuator is actuated to push at said biasing head, said elongated member is driven to push at said second position of said flushing shaft so as to move said valve seat from said idle position to said flushing position.

4. The flush system, as recited in claim 3, wherein said low volume pusher member comprises a pusher head and an elongated pusher pin which is extended from said pusher head to align with said first position of said flushing shaft and is arranged in such a manner that when said flush actuator is actuated to push at said pusher head, said pusher pin is driven to push at said first position of said flushing shaft so as to move said valve seat from said idle position to said flushing position.

5. The flush system, as recited in claim 4, wherein said elongated member of said high volume pusher member is a tubular member having a central cavity that said pusher pin of said low volume pusher member is slidably received in said central cavity, such that said pusher pin is slid within said tubular member to push at said first position of said flushing shaft.

6. The flush system, as recited in claim 5, wherein said biasing head of said high volume pusher member comprises a pusher seat coupling with said pusher head of said low volume pusher member and arranged in such a manner that when said flush actuator is actuated to push at said pusher head of said low volume pusher member, only said pusher head of said low volume pusher member is driven to push at said first position of said flushing shaft, and when said flush actuator is actuated to push at said biasing head of said high volume pusher member, both said low and high volume pusher members are driven to push at said flushing shaft.

7. The flush system, as recited in claim 6, wherein said flush actuator comprises an actuator handle pivotally coupling with said valve body and arranged in such a manner that when said actuator handle is pivotally actuated at one direction, said actuator handle drives said high volume pusher member to push at said second position of said flushing shaft, and when said actuator handle is pivotally actuated at an opposite direction, said actuator handle drives said low volume pusher member to push at said first position of said flushing shaft.

8. The flush system, as recited in claim 4, wherein said biasing head of said high volume pusher member comprises a pusher seat coupling with said pusher head of said low volume pusher member and arranged in such a manner that when said flush actuator is actuated to push at said pusher head of said low volume pusher member, only said pusher head of said low volume pusher member is driven to push at said first position of said flushing shaft, and when said flush actuator is actuated to push at said biasing head of said high volume pusher member, both said low and high volume pusher members are driven to push at said flushing shaft.

9. The flush system, as recited in claim 4, wherein said elongated member of said high volume pusher member and said pusher pin of said low volume pusher member are slidably extended side-by-side to push at said second and first positions of said flushing shaft respectively.

10. The flush system, as recited in claim 9, wherein said flush actuator comprises an actuator handle pivotally coupling with said valve body and arranged in such a manner that when said actuator handle is pivotally actuated at one direction, said actuator handle drives said high volume pusher member to push at said second position of said flushing shaft, and when said actuator handle is pivotally actuated at an opposite direction, said actuator handle drives said low volume pusher member to push at said first position of said flushing shaft.

11. The flush system, as recited in claim 10, wherein said first and second positions of said flushing shaft are lower and higher flushing positions thereof respectively that said lower flushing position is located below said higher flushing position with respect to said valve seat.

12. The flush system, as recited in claim 10, wherein said first and second positions of said flushing shafts are defined that when said low volume pusher member pushes to said first position, said flushing shaft is pushed in an inclination manner with a low volume flushing angle, and when said high volume pusher member pushes to said second position, said flushing shaft is pushed in an inclination manner with a high volume flushing angle, wherein said high volume flushing angle is larger than said low volume flushing angle with respect to said flushing shaft at its initial position.

13. The flush system, as recited in claim 1, wherein said high volume pusher member comprises a biasing head and an elongated member which is extended from said biasing head to align with said second position of said flushing shaft and is arranged in such a manner that when said flush actuator is actuated to push at said biasing head, said elongated member is driven to push at said second position of said flushing shaft so as to move said valve seat from said idle position to said flushing position.

14. The flush system, as recited in claim 13, wherein said low volume pusher member comprises a pusher head and an elongated pusher pin which is extended from said pusher head to align with said first position of said flushing shaft and is arranged in such a manner that when said flush actuator is actuated to push at said pusher head, said pusher pin is driven to push at said first position of said flushing shaft so as to move said valve seat from said idle position to said flushing position.

15. The flush system, as recited in claim 14, wherein said elongated member of said high volume pusher member is a tubular member having a central cavity that said pusher pin of said low volume pusher member is slidably received in said central cavity, such that said pusher pin is slid within said tubular member to push at said first position of said flushing shaft.

16. The flush system, as recited in claim 14, wherein said elongated member of said high volume pusher member and said pusher pin of said low volume pusher member are slidably extended side-by-side to push at said second and first positions of said flushing shaft respectively.

17. The flush system, as recited in claim 1, wherein said flush actuator comprises an actuator handle pivotally coupling with said valve body and arranged in such a manner that when said actuator handle is pivotally actuated at one direction, said actuator handle drives said high volume pusher member to push at said second position of said flushing shaft, and when said actuator handle is pivotally actuated at an opposite direction, said actuator handle drives said low volume pusher member to push at said first position of said flushing shaft.

18. The flush system, as recited in claim 1, wherein said first and second positions of said flushing shaft are lower and higher flushing positions thereof respectively that said lower flushing position is located below said higher flushing position with respect to said valve seat.

19. The flush system, as recited in claim 1, wherein said first and second positions of said flushing shafts are defined that when said low volume pusher member pushes to said first position, said flushing shaft is pushed in an inclination manner with a low volume flushing angle, and when said high volume pusher member pushes to said second position, said flushing shaft is pushed in an inclination manner with a high volume flushing angle, wherein said high volume flushing angle is larger than said low volume flushing angle with respect to said flushing shaft at its initial position.

* * * * *